US006662482B2

(12) United States Patent
Segan et al.

(10) Patent No.: US 6,662,482 B2
(45) Date of Patent: Dec. 16, 2003

(54) MOVING PANEL DISPLAY

(75) Inventors: Marc H. Segan, New York, NY (US); Gary Strauss, Mamaroneck, NY (US); Steven Parker, Katonah, NY (US)

(73) Assignee: The Animated Animation Company LLC, New York, NY (US)

( * ) Notice: Subject to any disclaimer, the term of this patent is extended or adjusted under 35 U.S.C. 154(b) by 115 days.

(21) Appl. No.: 10/014,048

(22) Filed: Nov. 13, 2001

(65) Prior Publication Data

US 2002/0095836 A1 Jul. 25, 2002

Related U.S. Application Data

(63) Continuation-in-part of application No. 09/573,994, filed on May 17, 2000.

(60) Provisional application No. 60/134,557, filed on May 17, 1999, and provisional application No. 60/166,280, filed on Nov. 18, 1999.

(51) Int. Cl.[7] ..... G09F 11/02

(52) U.S. Cl. ..... 40/503; 40/505

(58) Field of Search ..... 40/503, 505; 116/298; 160/134

(56) References Cited

U.S. PATENT DOCUMENTS

| | | | | |
|---|---|---|---|---|
| 1,466,776 A | | 9/1923 | White | |
| 1,637,579 A | | 8/1927 | Long | |
| 3,983,648 A | | 10/1976 | Hunter, Jr. | |
| 4,002,022 A | | 1/1977 | Lopez | |
| 4,189,859 A | | 2/1980 | Ahlgren | 40/505 |
| 4,528,763 A | | 7/1985 | Ahlgren | 40/505 |
| 4,638,580 A | | 1/1987 | Giannetti et al. | 40/503 |
| 4,759,140 A | | 7/1988 | Roberts et al. | 40/466 |
| 4,771,558 A | * | 9/1988 | Roberts et al. | 40/505 |
| 5,003,716 A | | 4/1991 | Dyar | 40/303 |
| 5,022,172 A | | 6/1991 | Kawahara et al. | 40/503 |
| 5,161,421 A | | 11/1992 | Stigsson | |
| 5,233,722 A | | 8/1993 | Bergeron et al. | 40/503 |
| 5,255,463 A | | 10/1993 | Werner | 40/505 |
| 5,255,465 A | | 10/1993 | Perez | 40/505 |
| 5,259,135 A | | 11/1993 | Bannister et al. | 40/503 |
| 5,315,776 A | | 5/1994 | Strawbridge et al. | 40/505 |
| 5,485,693 A | | 1/1996 | Frenken et al. | 40/505 |
| 5,562,459 A | | 10/1996 | Durlach | |
| 5,692,330 A | | 12/1997 | Anderson, Jr. | 40/505 |
| 5,696,494 A | | 12/1997 | Chen | |
| 6,178,675 B1 | * | 1/2001 | Strother | 40/503 |

FOREIGN PATENT DOCUMENTS

| | | | | |
|---|---|---|---|---|
| FR | 753999 | * | 10/1933 | 40/505 |
| FR | 1279653 | | 11/1961 | 40/505 |

* cited by examiner

*Primary Examiner*—Joanne Silbermann
(74) *Attorney, Agent, or Firm*—Cohen, Pontani, Lieberman & Pavane

(57) ABSTRACT

A display device for displaying to a viewer a message or a story, preferably accompanied by synchronized sound. The display device comprises a plurality of multi-sided, rotatable display elements, each side or panel bearing a visual image. The display elements are selectively rotated, preferably in groups, according to a predetermined sequence such that a message or story unfolds, step by step, to the viewer as different panels are displayed.

20 Claims, 19 Drawing Sheets

MOVING PANEL DISPLAY

RELATED APPLICATIONS

This is a continuation in part (CIP) application of U.S. patent application Ser. No. 09/573,994, filed on May 17, 2000, which claims priority from U.S. Provisional Patent Application Ser. No. 60/134,557, filed on May 17, 1999, and No. 60/166,280, filed Nov. 18, 1999.

BACKGROUND OF THE INVENTION

1. Field of the Invention

The present invention relates to a display having multi-sided, illustrated display elements movable in a predetermined sequence for creating a visual effect, which may present a message or story. The display optionally incorporates complementary sound and is preferably sufficiently thin to accommodate wall mounting or display on a stand, such as an easel.

2. Description of the Related Art

A wide variety of displays are well known in the art. Some, such as a standard billboard, present one or more immutable images. Others incorporate expensive electronic displays, such as cathode ray tubes or liquid crystal displays, which permit multiple and varying images to be displayed. While this latter class of device is far more interesting to the viewer and hence more likely to be memorable, the cost of such devices limits the number of viable applications.

SUMMARY OF THE INVENTION

The present invention is directed to a display for presenting to a viewer a plurality of images in a predetermined sequence, the sequential display of the images preferably presenting a message or story. Display of the images is preferably accompanied by sounds synchronized with and complementary to the displayed images.

In a preferred embodiment, the display of the present invention incorporates a plurality of multi-sided, for example three-sided, elongate display elements mounted for rotation in a housing. Each side of each display element or panel bears a visual image, which may be a complete image or, alternatively, a partial image such that multiple panels on multiple display elements form a complete image. When mounted in the housing, each display element is rotatable about its longitudinal axis such that its panels may be presented to the viewer in a predetermined sequence by controlling the display element's rotation, as by rotating the element clockwise, counterclockwise, or both.

Each display element includes an axle at one end on which a drive gear is mounted for engaging a motor driven gear for rotatably driving the display element. Although each display element may be driven independently, preferably multiple display elements are driven together for simultaneously presenting a plurality of new panels to the viewer upon each rotation, and most preferably different pluralities of display elements are sequentially rotated for presenting a visual message or story. The display elements may be mounted in the housing in any relative orientation and may be any size or shape, though preferably the display elements are all vertically or horizontally oriented and of triangular cross-section.

Typically the display device includes a plurality of motors for rotating the display elements, although as will be apparent hereinafter, the number of motors is preferably minimized to reduce size, complexity and expense. Operation of the motors is preferably controlled by a programmable microprocessor connected to a database containing program information defining the timing and sequence for rotating the motors for displaying the panels, as for presenting a message or story to the viewer. The database preferably also contains sound files corresponding to predetermined sounds, which may be speech, and program information defining the sequence for outputting the sound files, in which event the microprocessor is also connected to a speaker for playing the sounds in synchronization with display of the visual images.

In operation, the display elements are rotated in a predetermined sequence, preferably in synchronization with an audio output, such that as the panels are selectively displayed, a message or story unfolds, step by step, to the viewer. It is preferable that multiple display elements are rotated simultaneously, for example the display device may comprise twenty three-sided display elements divided into four groups or quadrants of five display elements each, with the panels in each group having coordinated visual images which are rotated simultaneously.

The display as a whole may be any shape, such as square, rectangular or circular. In one preferred embodiment, the display may include twelve radially arrayed display elements in the shape of a clock face, with one display element corresponding to each hour of the clock, and with a conventional analog clock module fitted at the center with its clock hands disposed in front of and parallel to the display elements. It will be apparent that to achieve a continuous, planar clock face, the display elements in this embodiment will preferably be tapered from a radially narrow inner end positioned at the center of the clock face, to a wider outer end. The clock face display elements will be rotatable via manipulation by a drive motor for providing different and varying images, with rotation of the display elements optionally occurring at a time event, such as a new hour. Alternatively, the display elements may be rotated in groups or individually. If desired, the visual images on the display element panels may be recognizable as time indicia in which event the CPU may be programmed to sequentially rotate of the display elements in synchronization with the time of day. This clock embodiment may include synchronized sound for audibly indicating a time event, which may be synchronized with rotation of the panels. Although a radial array of display elements is preferable, it is not necessary, and the "clock face" may be a rectilinear array of display elements, in which event the display elements need not be tapered or truncated. Moreover, the display elements may be of differing lengths to produce other than a circular-shaped display.

A display device in accordance with the invention may employ a battery driven motor, and to minimize power consumption the display elements are preferably constructed of a light-weight material and, most preferably, designed as hollow elements formed from a single sheet of cardboard or the like which is bent, for example, into a three-sided prism shape having a triangular cross-section, and then fitted, as by gluing, with plastic end caps that are engageable by the motor for manipulation. Alternatively, the display elements may be formed entirely of plastic. One or more panels of a display element may optionally have an opening formed therein for displaying an object mounted inside. Alternatively, or in addition, a three dimensional object may be mounted directly onto one or more panels of one or more of the display elements.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

It is expressly intended that various features and proposed modifications described in connection with any one embodiment are equally applicable, to the extent practicable, to every other embodiment, and this specification should be read with that understanding.

Figure 1:
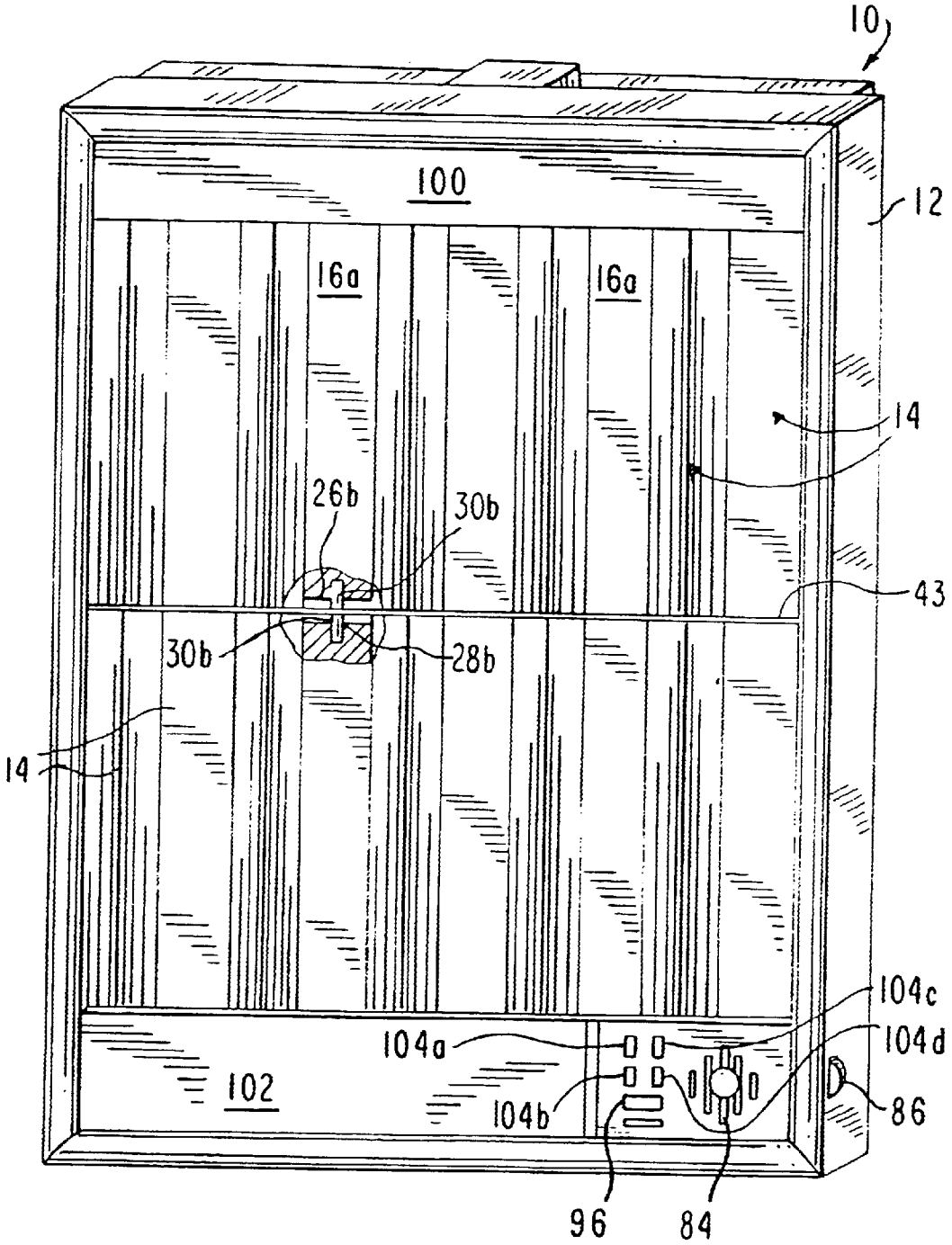
FIG. 1 is a perspective view, partly broken away, showing one embodiment of a display device in accordance with the present invention, wherein the visual images on the display elements have been omitted for ease of reference.

Referring initially to FIG. 1, a preferred display device 10 in accordance with the present invention comprises a rectangular housing 12 having a plurality of display elements 14 mounted for rotation therein. The housing is preferably comprised of plastic, though it may be made of other rigid materials, such as wood or metal. Although twenty display elements arranged in two equal rows are shown in FIG. 1, it will be apparent from this description that a lesser or greater number of display elements may be employed. Likewise, while the display elements are vertically oriented in FIG. 1, they can be oriented in any direction, or multiple directions, depending on the application, and likewise display elements of different sizes may be employed. Also, while the preferred housing is rectangular, that too is not necessary, and other shapes may be employed, one of which will be discussed below. The housing 12 preferably includes suitable structures on its rear surface to facilitate hanging, though alternatively the device 10 may be displayed on an easel or the like.

Figure 2:
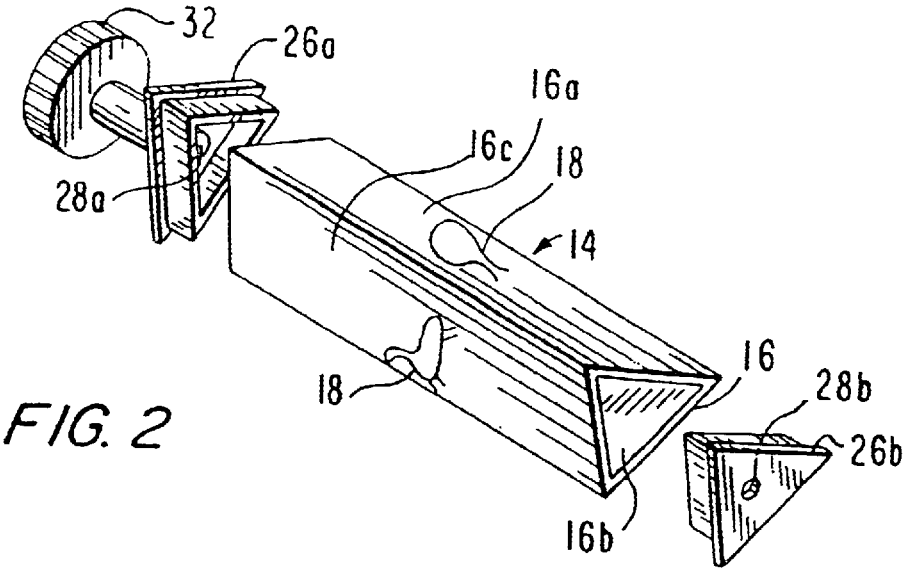
FIG. 2 is a perspective view of one embodiment of a display element for use in the display device of the present invention, with the visual images omitted for ease of reference.

As shown in FIG. 2, each display element 14 has a plurality of sides or panels 16, preferably three panels 16*a*, 16*b* and 16*c*. As shown in FIG. 1, the display elements 14 are mounted in housing 12 as close to each other as possible for collectively presenting a planar appearance when their panels 16 are parallel to the plane of viewing, though it will be apparent that some spacing is required to prevent interference between adjacent display elements during rotation. For this reason, forming each display element 14 with three panels 16 is considered optimal, as it minimizes the required spacing between display elements while providing a sufficient number of viewing surfaces to create interesting visual effects. However, for particular applications display elements can be formed with two or more than three panels. While the panels 16 are preferably planar, that is not required, and they may be convex, concave or even irregular. Typically, each panel 16*a*, 16*b*, 16*c* bears a visual image 18, such as, for example, a photograph, a drawing, a graphic, printed text, a single color, or any combination thereof. The visual image on a panel 16 may be a complete image or, alternatively, a portion of a complete image such that multiple panels 16 are required to form a complete image. Preferably, each of the three panels 16*a*, 16*b*, 16*c* of a display element 14 has a different visual image.

Figure 3A:
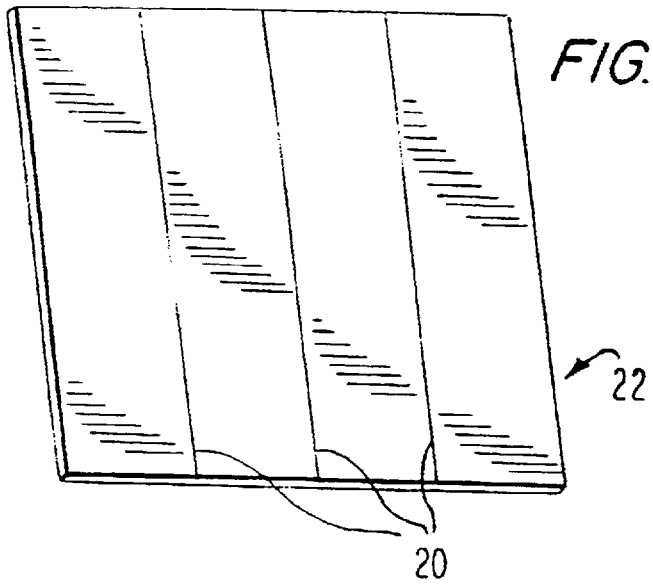
FIG. 3A is a perspective view of a scored, flexible sheet suitable for forming a display element.
Figure 3B:
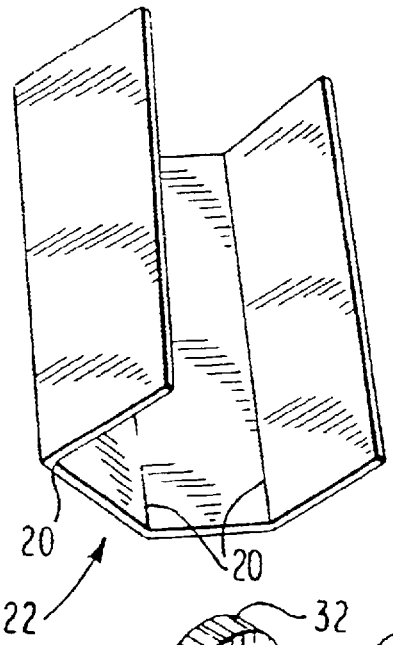
FIG. 3B is a perspective view showing the sheet of FIG. 3A in a partly folded condition.

Referring to FIGS. 3A and 3B, each display element 14 is preferably formed from a bendable semi-rigid sheet 22, such as cardboard or the like, which may be formed with score lines 20 to facilitate folding into the desired prism shape. Preferably the display element 14 is formed from a sheet 22 having three score lines 20 defining four equal sections such that when the sheet is folded into a prism, two of the sections overlap, the overlapping sections being glued for retaining the shape of the prism. By forming the display element in this fashion, no separate support structure is required, which minimizes expense and reduces weight, the latter being especially significant in battery-powered applications where low power consumption is desirable. Utilizing integral cardboard prisms also reduces shipping, assembly and tooling costs, lessens the likelihood of inertial damage during shipping, and reduces the required support for hanging or display. Although not preferred, the display elements 14 may also be formed of a rigid material, such as plastic, wood or metal.

The visual images 18 are preferably formed directly on the sheet 22, but may be formed on a separate sheet (not shown) which may then be glued to the outer surface of the sheet 22 after the prism is formed, though alternatively the separate sheet may be removably secured to the sheet 22, as by Velcro®. In addition to or in lieu of the visual images 18, objects may be affixed to the panels 16, with the proviso that they not interfere with rotation of the display elements 14.

Figure 4:
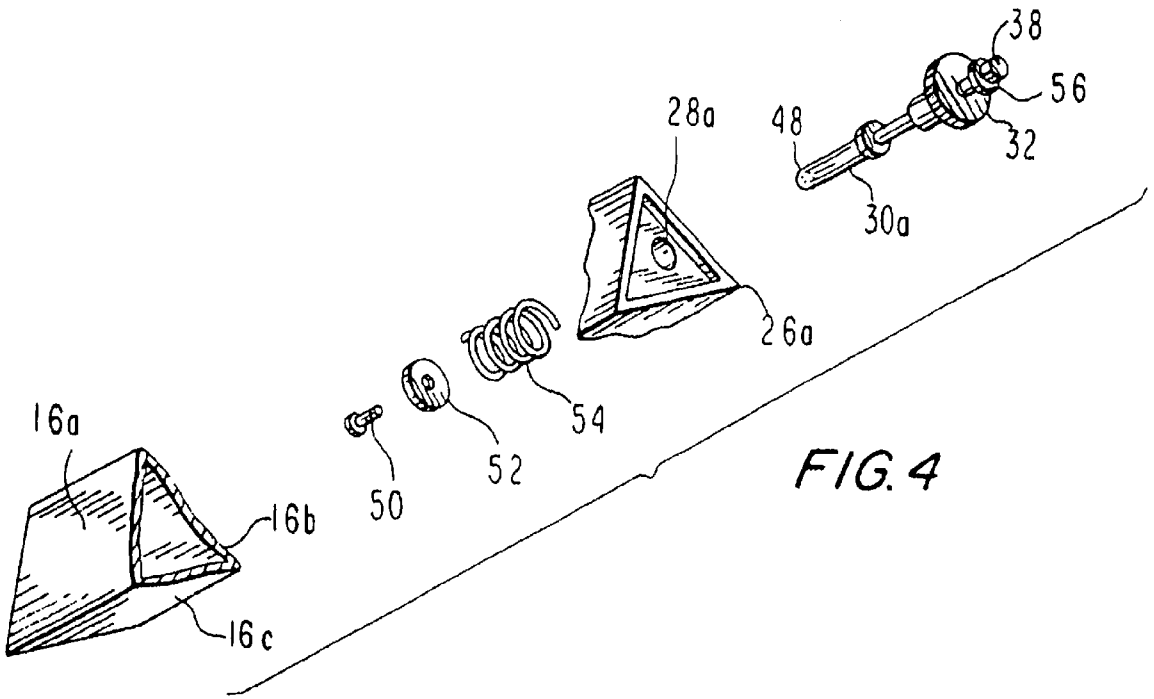
FIG. 4 is an exploded view showing one end of a display element.

As shown in FIGS. 2 and 4, each display element 14 includes two end caps 26*a*, 26*b*, one at either end. The end caps 26 are preferably formed of plastic, though other rigid or semi-rigid materials may be used. The end caps 26 are dimensioned for seating in the hollow ends of the prism formed by sheet 22 and are secured therein as by gluing. Each end cap 26*a*, 26*b* has an aperture 28*a*, 28*b* dimensioned for receiving an axle 30*a*, 30*b* for rotatably mounting the display element 14 in the housing 12.

Figure 6:
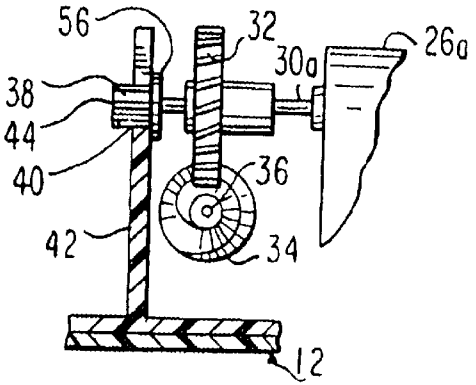
FIG. 6 is a view taken substantially along the line 6—6 in FIG. 5.
Figure 5:
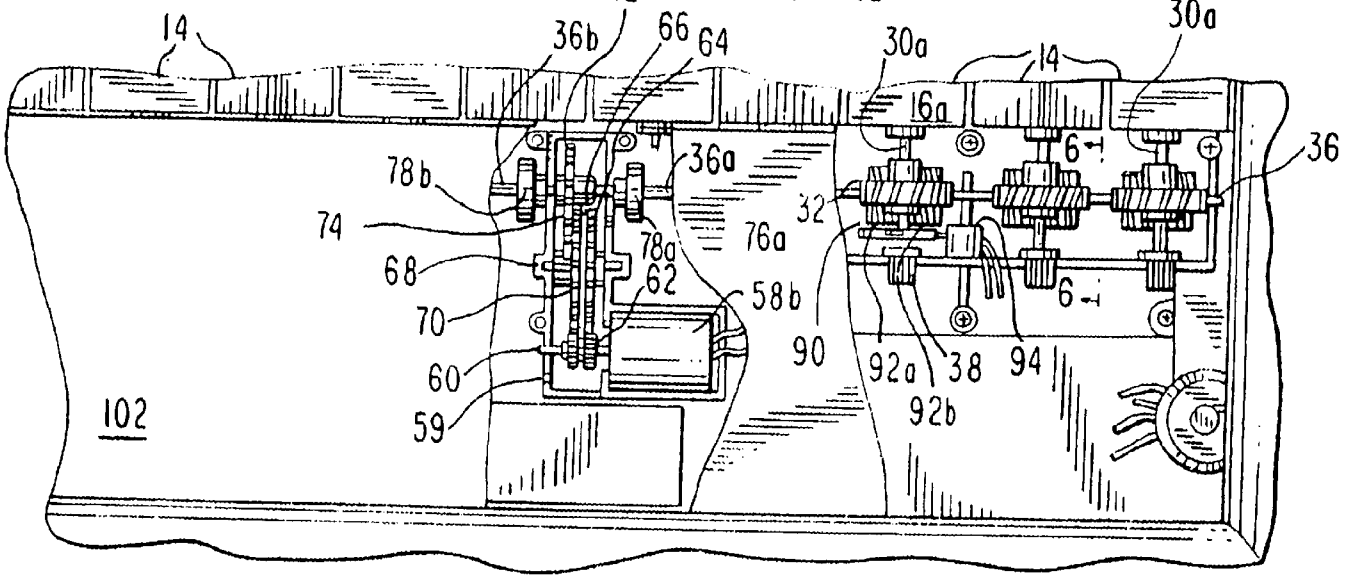
FIG. 5 is a partial elevational view, partly broken away, showing a drive mechanism for rotating the display elements in a device in accordance with the present invention.

Referring now to FIGS. 4, 5 and 6, the axle 30*a* at the driven end of each display element 14 is fitted with a gear 32 which mates with and is driven by a worm gear 34 on a drive shaft 36. In the preferred embodiment there are four drive shafts 36*a*, 36*b*, 36*c*, 36*d*, each one driving five display elements 14. As shown, the free end of each axle 30*a* is fitted with a journal 38 which seats in an aperture 40 in a support element 42 formed in housing 12. Each journal 38 has a pair of tabs 44 which snap fit beneath corresponding undercuts formed in support element 42 for blocking rotation of the journal as the axles 30*a* rotate. Snap fitting journals 38 in support element 42 facilitates assembly and repair, as it renders the display elements 14 readily removable and replaceable. It also facilitates custom imaging applications since an entire device, including electronics and drive mechanisms may be completely assembled, with the device completed by simply snapping the custom display elements 14 into place.

As illustrated in FIG. 4, the portion of axle 30*a* extending through end cap 26*a* has a threaded axial hole 48 which receives a screw 50 which supports a washer 52. One end of a coil spring 54 disposed about axle 30*a* seats against washer 52, the other end of the spring abutting the inside face of the end cap 26*a* for urging the end cap and hence the display element 14 towards the support element 42. As best shown in FIG. 6, movement of the display element 14 towards the support element 42 is restricted by an annular face 56 on journal 38 which abuts the side of the support element 42 facing display element 14. By urging the display elements 14 towards the support element 42, axial shifting of the display elements is prevented thereby keeping the display elements in alignment. It should also be appreciated that frictional engagement of spring 54 with washer 52 and end cap 26*a* defines a slip clutch for transmitting rotation of axle 30*a* to display element 14. Use of a slip clutch is preferable to fixedly secure axle 30*a* to end cap 26*a* because it allows axle 30*a* to rotate relative to display element 14 in the event rotation of the display element is blocked, for example by a child's finger, thereby reducing both the risk of injury and damage to the drive mechanism. This arrangement also allows a user to manually rotate the display elements 14 with ease to correct any rotational misalignment of the display elements. Use of a slip clutch also simplifies assembly, as there is no requirement for accurate alignment of gears 32 and worm gears 34, since any required adjustment can be made after assembly is complete by simply manually rotating the display elements 14 to their correct positions. As shown in FIGS. 1 and 2, the axles 30*b* seat in apertures 28*b* in end caps 26*b* when the device 10 is assembled. The axles 30*b* for all the display elements 14 are integrally formed in a support element 43 integral with housing 12 and positioned between the upper and lower display elements 14. The support element 43 is preferably as thin as is practical for minimizing the spacing between the upper and lower display elements.

Figure 8:
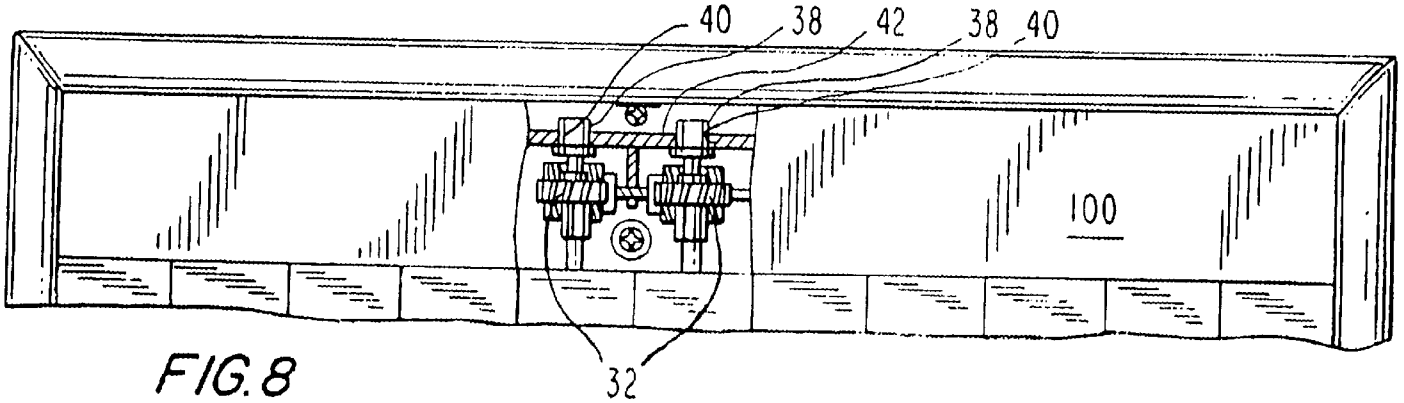
FIG. 8 is a partial elevational view, partly broken away, showing a part of the drive mechanism at the top of the display device shown in FIG. 1.
Figure 7:
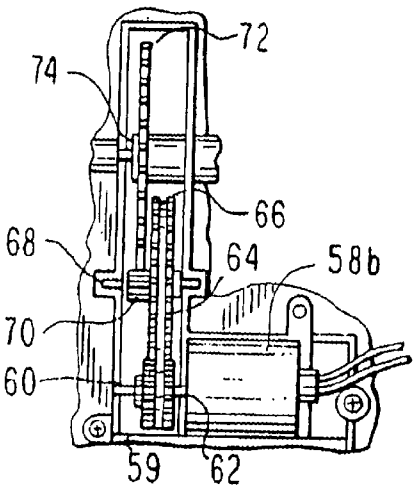
FIG. 7 is an enlarged view of a motor drive shown in FIG. 5.

Referring now to FIGS. 5, 7 and 8, the drive mechanism for display device 10 includes two motors 58*a*, 58*b*, one at the top and one at the bottom of the housing 12. Because the structure and operation of each motor drive is the same, only the motor drive 58*b* is shown and will be described in detail, though it should be understood that an identical motor drive 58*a* is included, but not shown, between the gears 32 in FIG. 8. Motor 58*b* drives ten display elements 14, but only drives five display elements at any given time. Motor 58*b* is secured, as by screws, in a motor housing 59 integrally formed in housing 12, the motor shaft 60 being journaled in a recess in a wall of the motor housing. A circumferentially grooved gear 62 on motor shaft 60 drives another circumferentially grooved gear 64 and its axle 68, the axle 68 also being journaled in the motor housing. Gear 62 drives gear 64 via a band 66, and this arrangement is preferred as it prevents motor shaft 60 from locking in the event rotation of the downstream driven elements is blocked. A toothed gear 70 on the axle 68 drives a larger gear 72 and its axle 74. The ends of the axle 74 drive, respectively, clutches 78*a*, 78*b* which, in turn, drive the drive shafts 36*a*, 36*b*. The clutches 78*a*, 78*b* are one way clutches of a type well known in the art, with clutch 78*a* engaging drive shaft 36*a* for rotation when motor 58*b* drives axle 74 in one direction and clutch 78*b* engaging drive shaft 36*b* for rotation when axle 74 is driven in the other direction. It will be apparent, therefore, that by driving the motor 58*b* in one direction or the other, the five display elements 14 at the bottom left or the five display elements 14 at the bottom right of the device 10 may be simultaneously rotated. Preferably the display elements 14 in the bottom left quadrant and the bottom right quadrant rotate in opposite directions, as this aids in avoiding jamming between the adjacent display elements in these two quadrants. It should now be appreciated that by driving the other motor 58*a* (not shown) at the top of device 10 in one direction or the other, the five display elements 14 at the top left or top right quadrants of the device 10 may be simultaneously rotated, and preferably the display elements in these quadrants also rotate in opposite directions. While the use of two motors for driving four groups of display elements is preferred, it will be appreciated that four motors could be used, in which event each group of display element could be rotated independently, both clockwise and counterclockwise, though obviously this would add additional expense. As a yet more costly alternative, each display element could be independently driven by its own motor.

As best seen in FIGS. 5 and 8, housing 12 includes upper and lower removable panels 100 and 102, respectively, which provide access to the drive mechanisms and electronics of the device 10. For example, the panels 100, 102 may be secured to the main body of the housing by screws. Preferably the undersides of the panels 100, 102 are configured with projections which seat above the journals 38 for axles 30*a* for preventing these axles from accidentally dislodging, as when the device is moved, though any such dislodgment is also impeded by the snap fit of journals 38 in support element 42.

Figure 9:
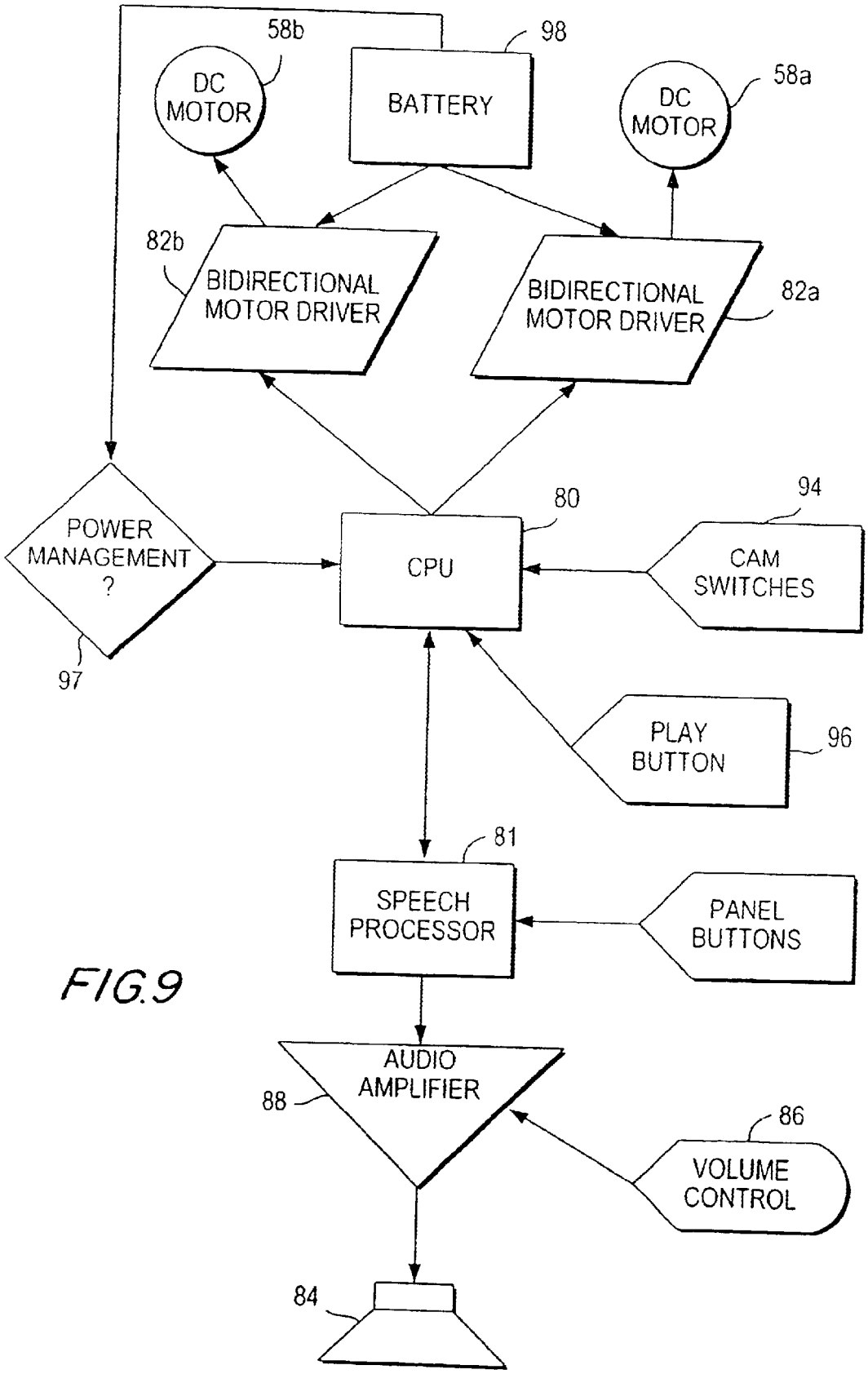
FIG. 9 is a block diagram representation of the circuitry for operating the display device of FIG. 1.

Referring now to FIGS. 1 and 9, rotation of the motors 58*a*, 58*b* is controlled by a microprocessor 80 programmed with a database containing information defining the sequence, timing and direction of rotation of the motors. In a manner well known in the art, the microprocessor 80 is electrically connected to the motors 58*a*, 58*b* via motor drive circuits 82*a*, 82*b*. It will be appreciated that microprocessor 80 may be programmed to rotate motors 58*a*, 58*b* simultaneously, separately or not at all, so at any given time ten, five or none of the display elements 14 will be rotating, the particular display elements undergoing rotation being dependent on the direction of motor rotation as explained above. In the embodiment illustrated in FIG. 1, a speech processor 81 is also programmed with digital sound information timed for play in coordination with the visual images displayed to the viewer on the panels 16 of the display elements 14. For this purpose a speaker 84 and a volume control 86 are secured in housing 12, the speaker being electrically connected to microprocessor 80 via suitable amplifying circuitry 88. As shown, the circuits for device 10 are preferably powered by batteries 98 supported in housing 12, though line power could be employed in lieu of or in addition to battery power.

Referring to FIG. 5, one of the five display elements 14 in each driven group has an alignment gear 90 secured on axle 30*a* between gear 32 and journal 38. Alignment gear 90 has three radial protrusions 92*a*, 92*b* and 92*c*, one for each panel 16 of display element 14, the leading edges of the protrusions being 120 degrees apart. The alignment gear 90 is in close spaced relation with a contact switch 94 which closes each time it engages one of the protrusions 92*a*, 92*b*, 92*c*. The switch 94 is electrically connected to the microprocessor 80, and in this way the switch "tells" the microprocessor which of the panels 16 on the display element 14 is presented to the viewer at any given time. One of the radial protrusions 92*a* is longer than the others for identifying, by extended closure of switch 94, a particular one of the panels 16, for example panel 16*a*. As a result, the microprocessor "learns" which panel is facing the viewer by sensing closure of switch 94 in response to protrusion 92*a*, which indicates that panel 16*a* is facing the viewer, and then counting the number of times the contact switch is closed thereafter, each closure corresponding to rotation of a new panel into view.

When the device is activated by depressing "play" switch 96, the microprocessor 80 uses information from the four contact switches 94 to rotate the display elements 14 to their correct initial positions, at which point the microprocessor deactivates the motors 58*a*, 58*b*. Should any of the display elements 14 be rotationally misaligned at this point, it is a simple matter, as explained above, for a user to manually rotate the misaligned display elements to their correct positions. For this purpose, a code, such as a letter number or symbol, can be printed on one or all panels 16 of each display element 14. For example, the code may be printed only on the panels 16 which face the viewer when the display elements 14 are in their initial positions. The color of the printed code can be chosen to blend with the visual images 18 such that at normal viewing distance, i.e., 3 feet or greater, the codes are invisible, but at close-up they are readable for facilitating re-alignment of the display elements. The codes are also useful for facilitating correct assembly of the device at the factory.

To facilitate manual realignment, the microprocessor may be programmed to effect a short pause after the display elements 14 are rotated to their starting positions. While each separate display element 14 could be fitted with its own alignment gear and contact switch, that is considered unnecessary because the display elements are always rotated in groups of five and fitting one display element in each group therefore provides sufficient positional information to the microprocessor 80.

The microprocessor 80 may be programmed to rotate the motors 58*a*, 58*b* at only one speed or, preferably, more than one speed, and most preferably two speeds, as this allows the speed of rotation to be coordinated with the visual content and the soundtrack for enhancing the visual impact of the device 10. To accomplish dual speed motor operation, duty cycle modulation, such as a pulse width modulation, may be employed, with the fast speed achieved by applying full output power from the power source to the motors 58*a*, 58*b* and the slow speed achieved by duty cycling the power from the power source. When the device 10 is battery powered and the batteries are weak, slow speed operation may generate insufficient torque to rotate the display elements 14 at a sufficient speed, and in an extreme situation the torque may be insufficient to effect any rotation of the display elements. To compensate for weak batteries, pulse width modulation may be employed to gradually increases the duty cycle until the display elements are rotating at a desired speed, which may be sensed by closure of contact switches 94 as explained above. If the batteries are very weak, the duty cycle may have to be increased to full output power, in which event the fast and slow speeds will be the same. Nevertheless, this arrangement allows the microprocessor to be programmed for slow speed operation for maximum visual impact when the batteries are strong, without facing premature failure of device 10 when the batteries are weak, which is particularly important in situations where the device may be left on for extended periods. Duty cycling may be implemented by digital signal simulation techniques, preferably using microprocessor 80, or by analog circuitry, both techniques being well known in the art and diagrammatically represented at 97 in FIG. 9. In addition to controlling the speed of the motors 58*a*, 58*b*, the microprocessor 80 may be programmed to rotate the display elements 14 more than one complete revolution before pausing to display a particular group of panels, as this too adds to the visual impact. This is easily accomplished using the positional information conveyed by contact switches 94.

Figure 10A:
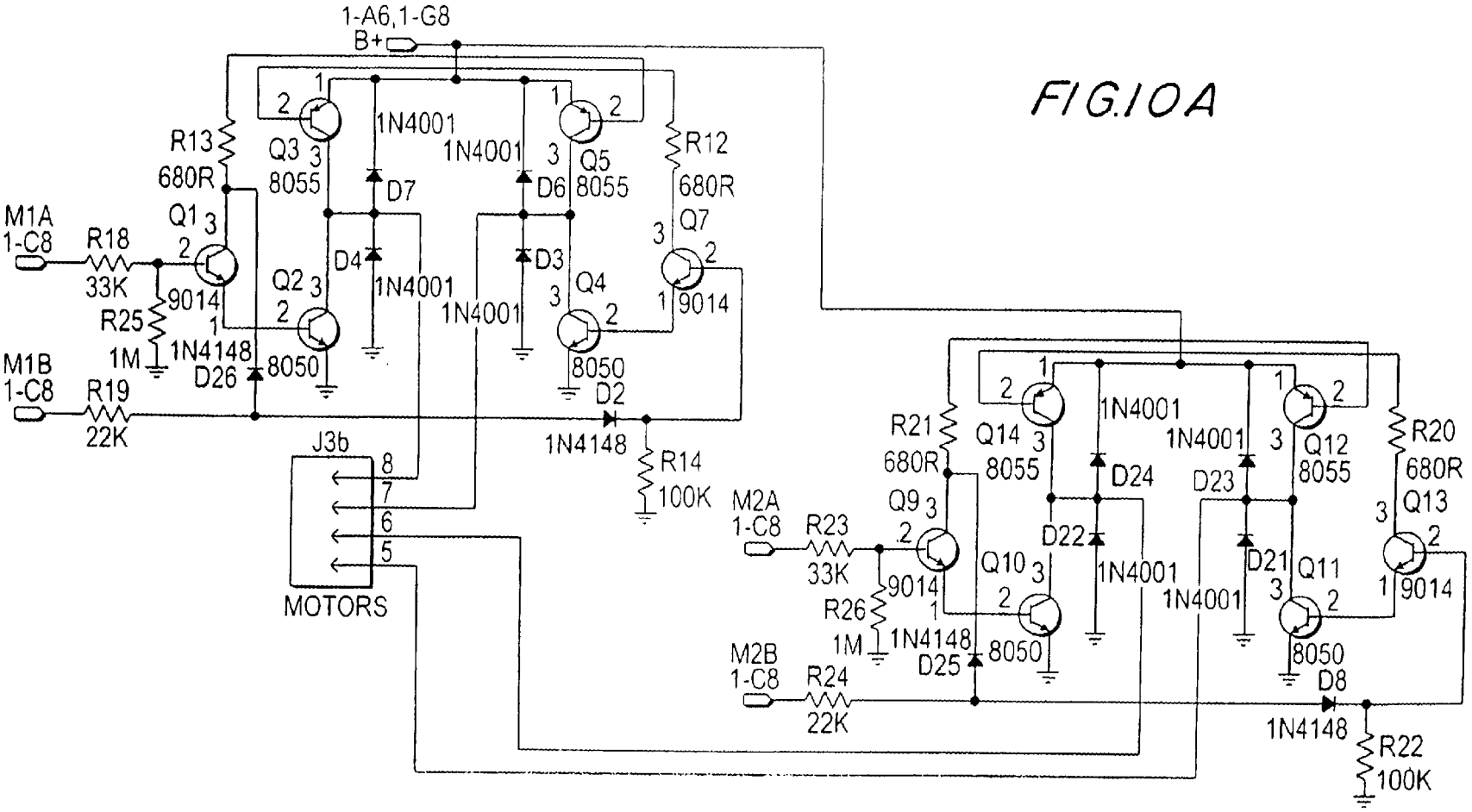
FIGS. 10A and 10B show a schematic diagram of the circuitry for operating the display device of FIG. 1.
Figure 10B:
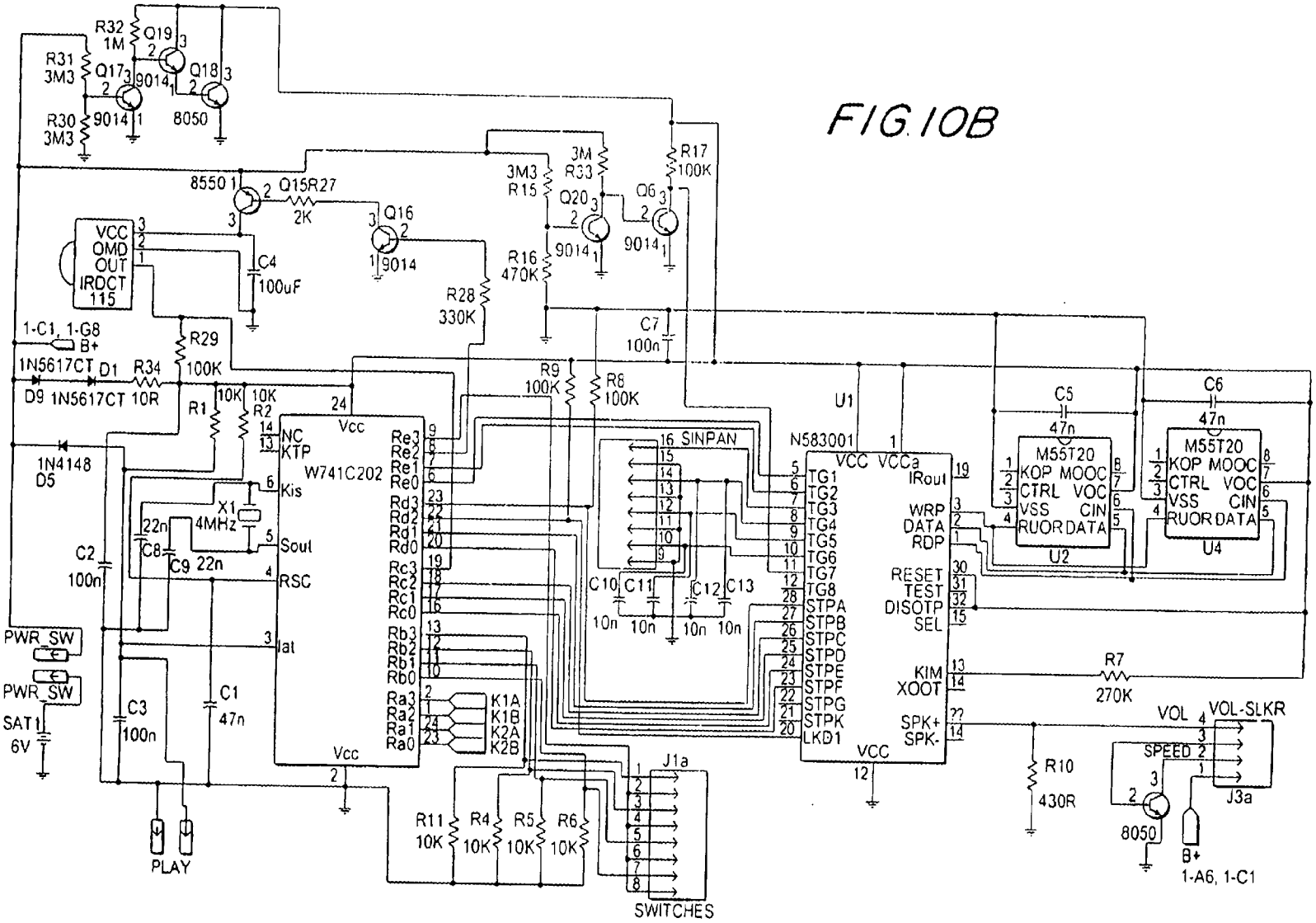

A schematic diagram of the circuitry for the device 10 is shown in FIG. 10.

Preferably the information database for directing the timing, sequence and direction of motor rotation is stored in the memory of microprocessor 80 and the information database for the sound track is stored in the memory of the speech processor 81. Although the microprocessor 80 and speech processor 81 may be fixedly secured in the device 10, they may be removable, in which event the play sequence and/or the sound track may be changed by substituting components having different information databases. It will be further apparent from the foregoing description that upon removal of the upper and lower panels 100, 102, the display elements 14 may also be removed and replaced, and if this is done in conjunction with replacement of microprocessor 80 and speech processor 81, the play of the device 10 may be completely altered.

It is also possible to store multiple play sequences in a single microprocessor and/or multiple sound tracks in a single speech processor, such that the play sequence and/or sound track may be selected by the user or randomly chosen by the microprocessor, with each such play sequence and/or sound track being appropriate for the particular artwork on display elements 14. The microprocessor and/or speech processor may also store additional play sequences and sound tracks, respectively, keyed to one or more of the groups of display elements. For example, referring to FIG. 1, pushing rectangular button 104*a* activates a play sequence and sound track keyed to the upper left quadrant of display elements, i.e., motor 58*b* is idled and motor 58*a* is driven only in the direction which rotates those display elements, the upper left quadrant being rotated in a sequence predetermined by microprocessor 80 to the accompaniment of a complementary sound track. Similarly, each of the other buttons 104*b*, 104*c*, 104*d* activates a different quadrant of display elements.

Figure 11A:
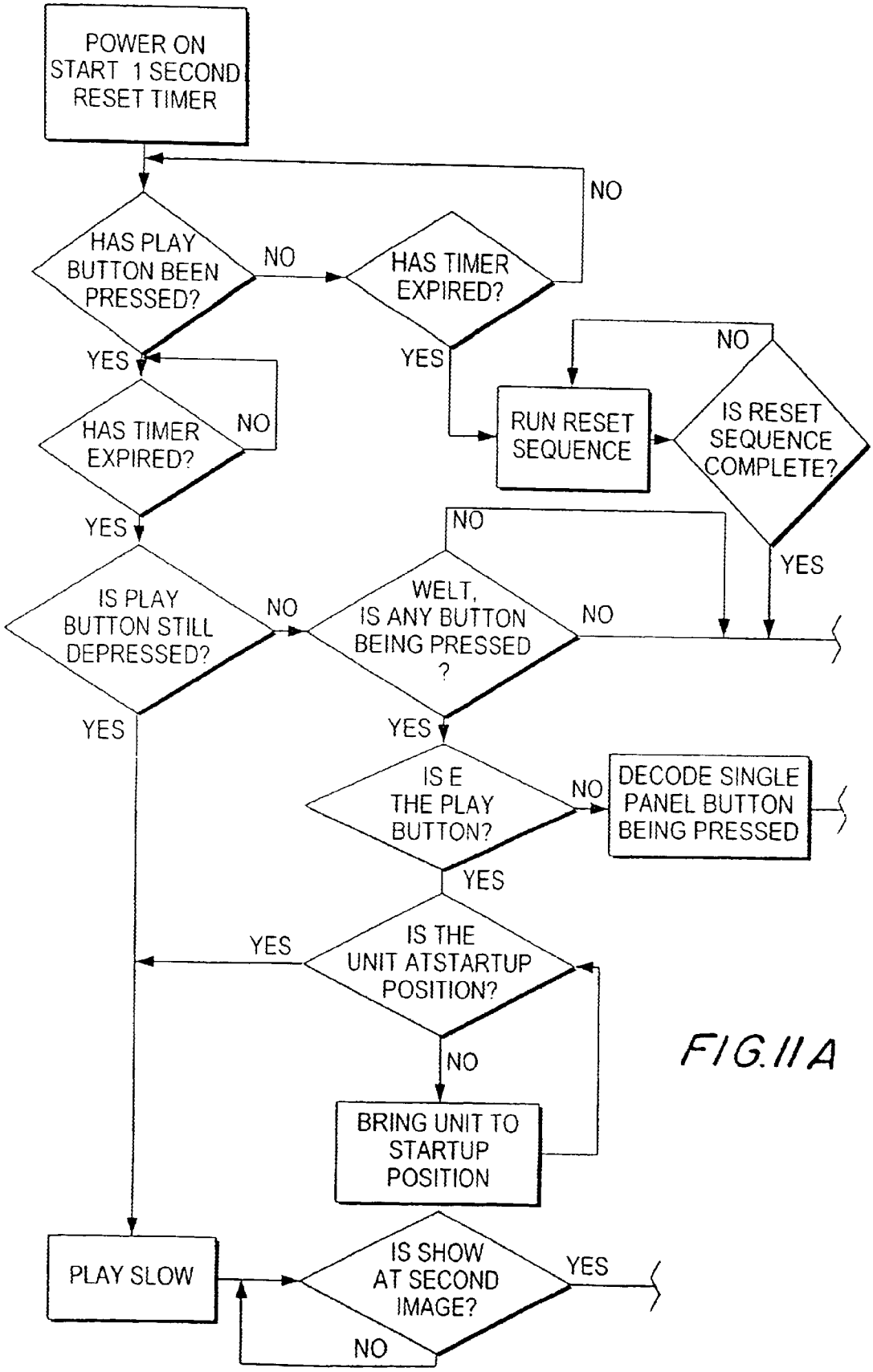
FIGS. 11A and 11B depict an operational flow diagram for the display device depicted in FIG. 1.
Figure 11B:
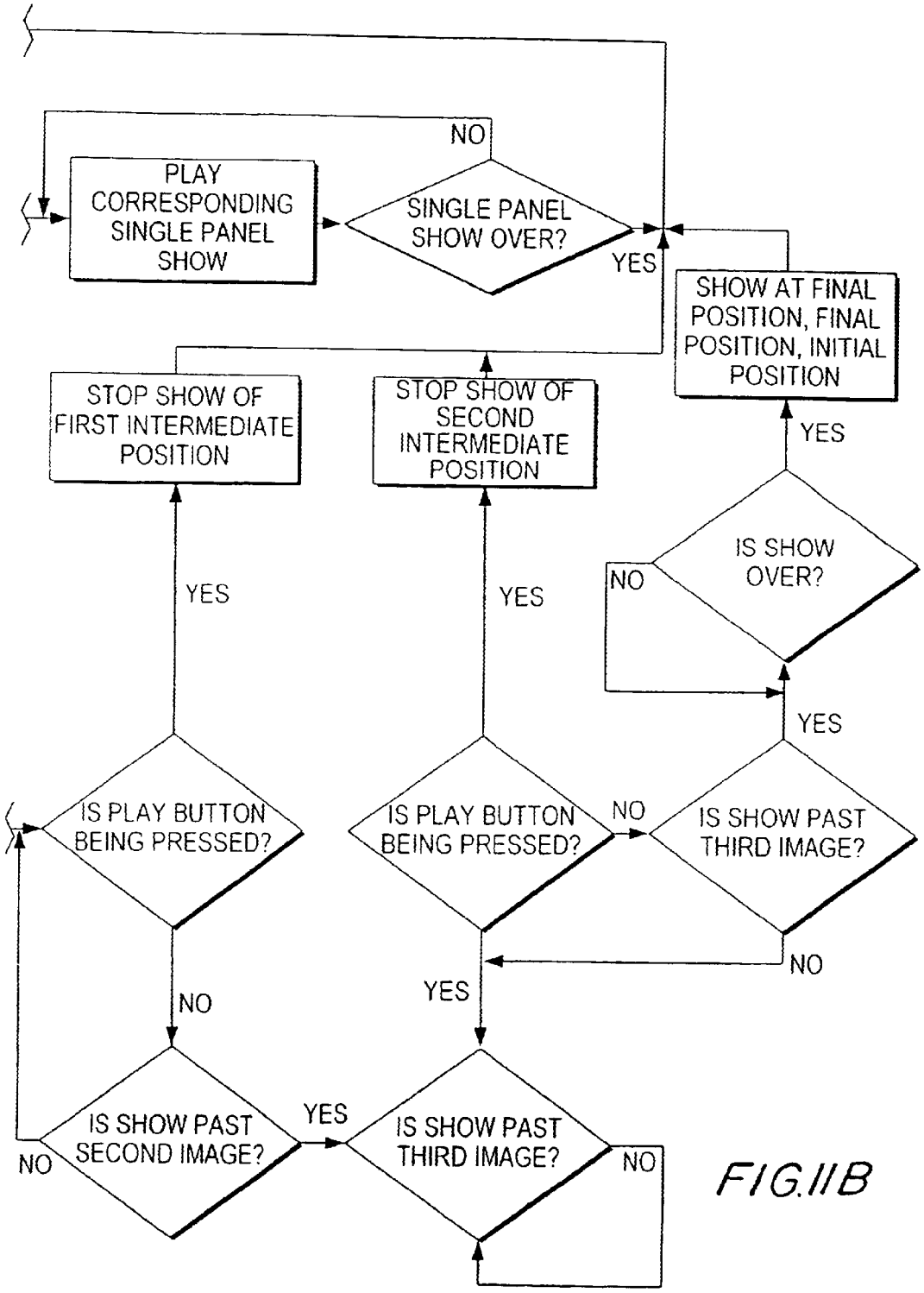

An operational flow chart for the device 10 is shown in FIG. 11

While the embodiment shown in FIG. 1 is activated by controls on the housing 12, alternatively, or in addition, remote controlled activation, as by infrared signals, may be employed. The functions on the remote controller may include initiating a play sequence in a long format or a short format, muting of sound, pause, initiating a story at an intermediate position, causing particular quadrants to rotate in a prescribed manner, selecting particular sound tracts, etc. Once this description is known, such functions and their implementation by microprocessor 80 and speech processor 81 will be readily apparent.

It is also possible for multiple devices 10 in proximity to each other to interact, with proximal units recognizing each other by, for example, infrared transmissions. Detection of a proximal device 10 may trigger complementary play sequences and/or sound tracks in the proximal devices, such play sequences and sound tracks being stored in microprocessor 80 and speech processor 81 and only activated when one or more other devices 10 are detected. For this purpose, each different version of display device 10 may output a unique infrared signal identifiable by proximal devices for triggering an appropriate play sequence and/or sound track.

As a further alternative, lighting (not shown) may be synchronized with the visual images displayed by the device 10. For example, specific areas can be lighted in synchronization with events in the unfolding story and flashed or faded as appropriate. Black light may also be employed to reveal or accentuate "day-glo" features.

Figure 12:
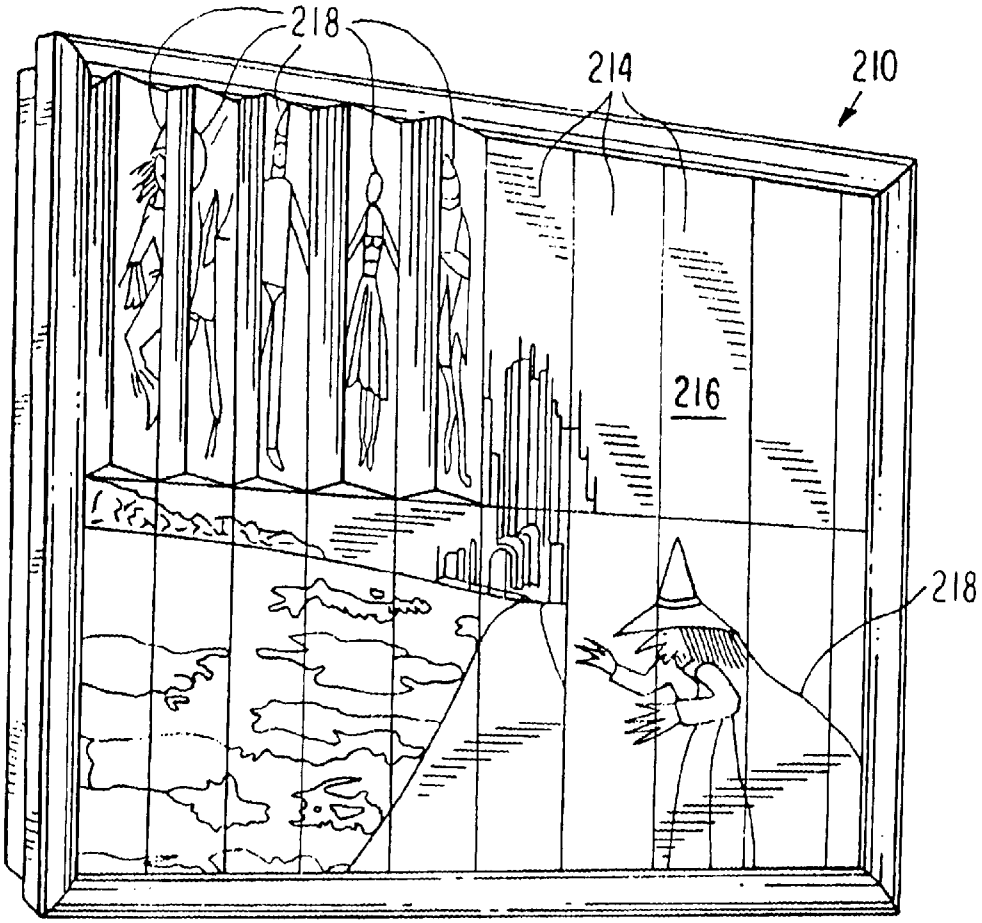
FIG. 12 is a perspective view of another display device in accordance with the present invention.
Figure 13:
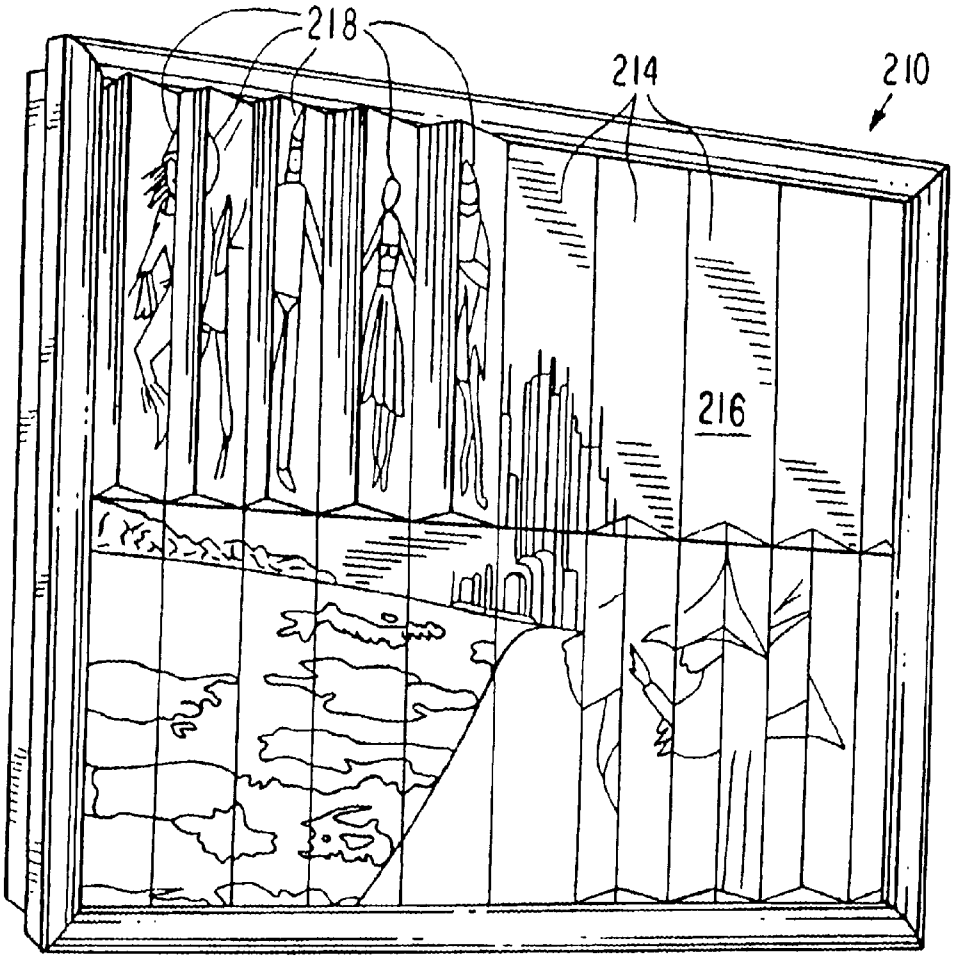
FIG. 13 is another perspective view of the device shown in FIG. 12, but with the display elements rotated to a different position.

A display device 210 of the present invention with a Wizard of Oz theme is shown in FIGS. 12 and 13 in two operating positions. The device 210, like the device 10, has four quadrants, but the quadrants are not all equal, i.e., the upper left and upper right quadrants each comprises five display elements 214, the lower left quadrant comprises four display elements 214 and the lower right quadrant comprises six display elements 214. In FIG. 12, which may represent a starting position, the palace in Oz is formed by eleven panels 216, five from the upper right quadrant and six from the lower left quadrant. An image of the Wicked Witch of the West is formed by the four panels 216 in the lower right quadrant. The five panels 216 in the upper left quadrant, which are in the process of rotating to their next position, depict the Scarecrow, the Tin Man, Dorothy and the Lion. Preferably the depiction in FIG. 12 is accompanied by a complementary sound track generated by a speech processor.

Under the control of its microprocessor, and referring now to FIG. 13, the device 210 continues its play sequence by rotating the display elements 214 in the lower right quadrant for replacing the illustration of the Wicked Witch of the West with a different visual image appropriate to the story line. The other quadrants are likewise rotated such that the illustration of the palace and the four other characters are also replaced by other illustrations from the story. Preferably, all the while the speech processor generates words and/or music appropriate to the visual images displayed to the viewer. For example, when the device is in the position depicted in FIG. 12, the speaker (not shown) may output a segment from the story pertaining to the Wicked Witch of the West, and as some or all of the panels are rotated to their next position, a segment of the story appropriate to the new visual images may be outputted. Because there are four independently rotatable quadrants with three images 218 on each display element 214, it will be apparent that there are a large number of combinations of visual images which can be displayed to the viewer, and therefore a typical play sequence which avoids duplication may be 60 seconds or more depending, for example, on the speed of rotations. Although in FIGS. 12 and 13 visual images 218 from a story are depicted, the visual images may relate to any desired topic, such as advertising material, including images and/or text. Where some or all of the visual images comprise characters, which may be human characters, conversation between the characters may be simulated by the sound track.

In addition to the display device embodiments discussed above which employ display elements having uniform cross-sections, the display device of the invention may include display elements having non-uniform cross-sections. For example, as shown in FIGS. 14–17, an alternative display device 300 may be in the shape of a clock face formed by twelve equal-sized truncated display elements 314 having end caps 326*a* and 326*b*. A conventional analog clock movement 315 may be secured at the center of the device with clock hands disposed in front of and parallel to the display elements 314. Although the panels 316 are shown as having a tapered trapezoidal cross section, that is not necessary, and the panels may be any suitable shape, and while a round clock face is preferred, other shapes are possible. In the example shown in FIGS. 14–17, each display element is driven by a respective gear 332 (the axles are omitted for the sake of clarity, but their structure will be apparent from the preceding description), and all the gears 332 are in communication with and simultaneously driven by crown gear 333. Rotation of the display elements 314 to form a new clock face may be coordinated with a time event, such as a new hour, and preferably rotation is accompanied by a suitable sound track, which may be music, a voice announcing the time, or both. The visual images 318 on the panels 316 may include recognizable time indicia, in which event the microprocessor may be programmed to sequentially time the rotation of the display elements 314 with the time of day, for example on the hour.

Figure 22A:
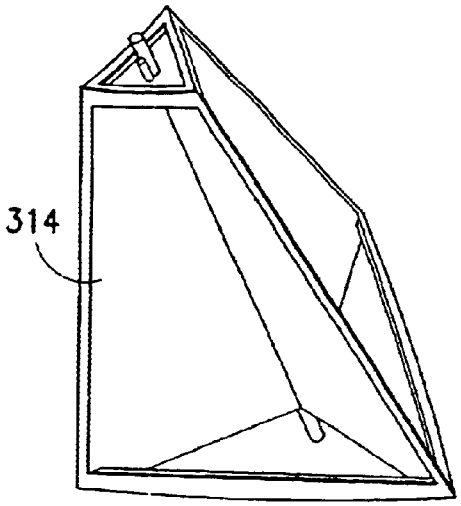
FIGS. 22A and 22B are perspective and end views, respectively, of the truncated display element having the structure depicted in FIG. 15.
Figure 22B:
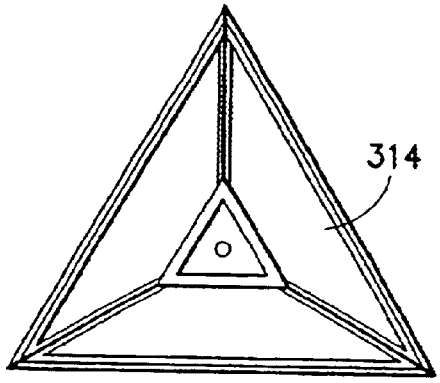

It should be appreciated that as the display elements 314 resemble 3-dimensional tapered prisms wherein the outer most ends are wider relative to the inner most ends (as shown in FIGS. 22A and 22B) to produce a substantially planar circular display—which is desirable when simulating a clock face, for example, the individual display panels must be arranged so that their respective rotational axes are not coplanar with the display, but intersect the display plane. This configuration is best shown in FIG. 23.

Figure 14:
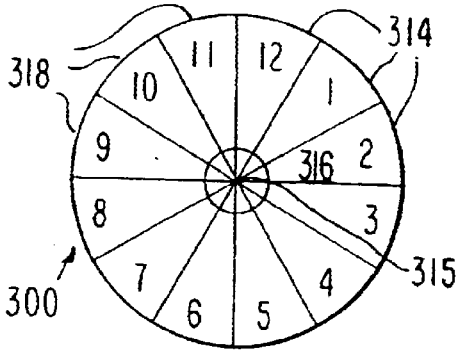
FIG. 14 is a plan view of a display device in accordance with the invention configured as a clock face.
Figure 23:
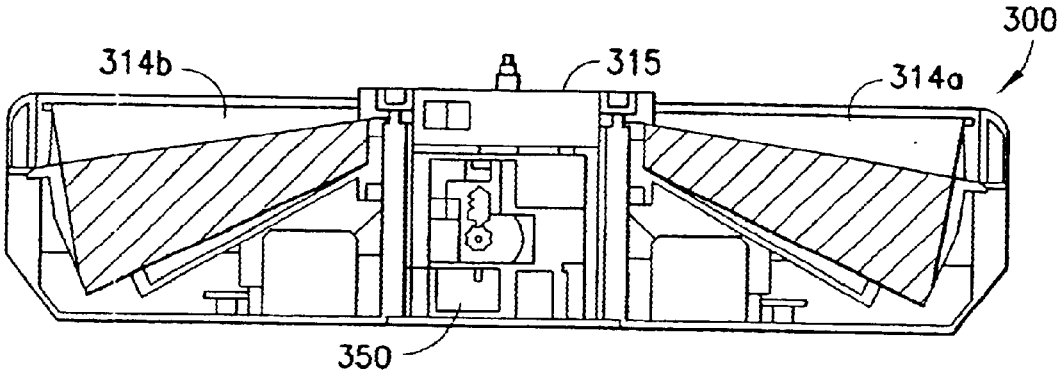
FIG. 23 is a more detailed illustration of FIG. 17.

The geometry resulting from the display element arrangement of FIG. 23 dictates that the display elements be rotated in groups to prevent an adjacent display element from interfering with the movement of its neighbor element, i.e. to provide sufficient clearance from adjacent panels during rotation. Thus, the display elements 314 may be individually driven, or driven in groups. For example, two groups of display elements 314*a* and 314*b* may be interleaved with each other (as shown in FIG. 14) and activated at different times so that one subset of display elements (e.g., subset 314*a*) initially rotates in one direction and another subset of display elements (e.g., subset 314*b*) rotates in the same direction but at a later time. For example, the subset display elements 314*a* for the odd hours simultaneously move together in one direction, and the subset display elements 314*b* for the even hours simultaneously move together in a common direction. The rotation of two sets of three-sided display elements 314 displays six possible combinations of images or pictures.

Although all the display elements 314 in the embodiment of FIGS. 23 to 29 move in one direction, one or more display elements 314 may rotate independently and/or in opposite directions. However, such movement of display elements 314 would require additional gear assemblies and corresponding motors. This increases the complexity and cost of producing the display device 300.

Figure 15:
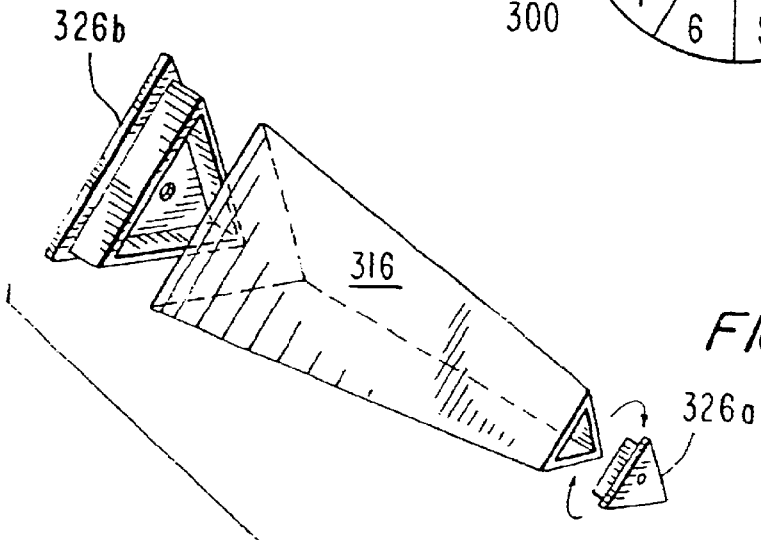
FIG. 15 is an exploded view of part of the display device of FIG. 14.
Figure 16:
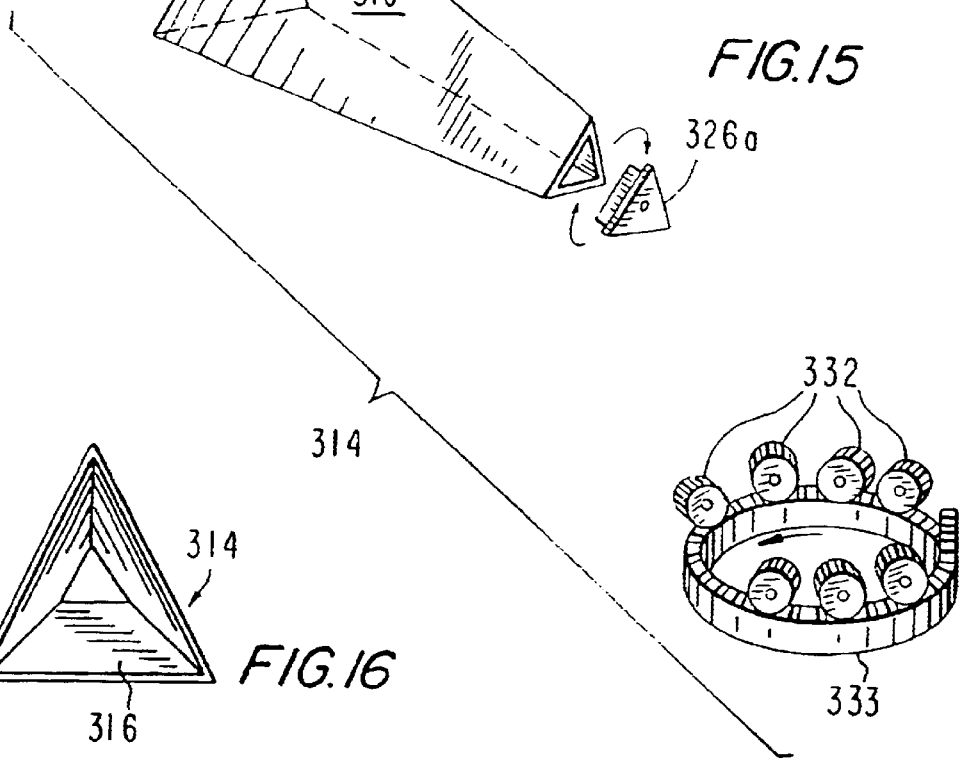
FIG. 16 is an end view of a truncated display element used in the device of FIG. 14.
Figure 16:
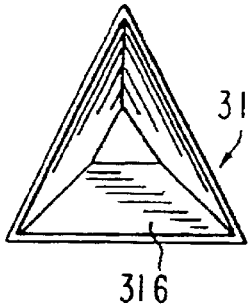
Figure 17:
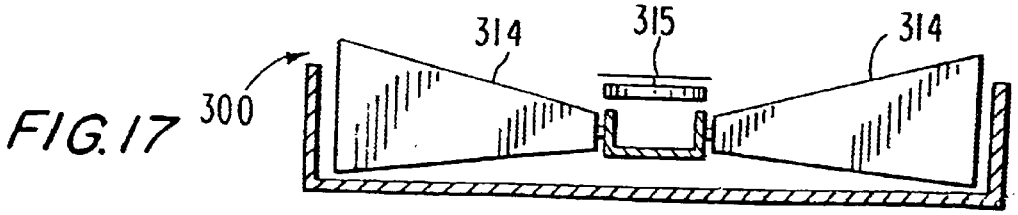
FIG. 17 is a cross-sectional illustration of the display device of FIG. 14.
Figure 18:
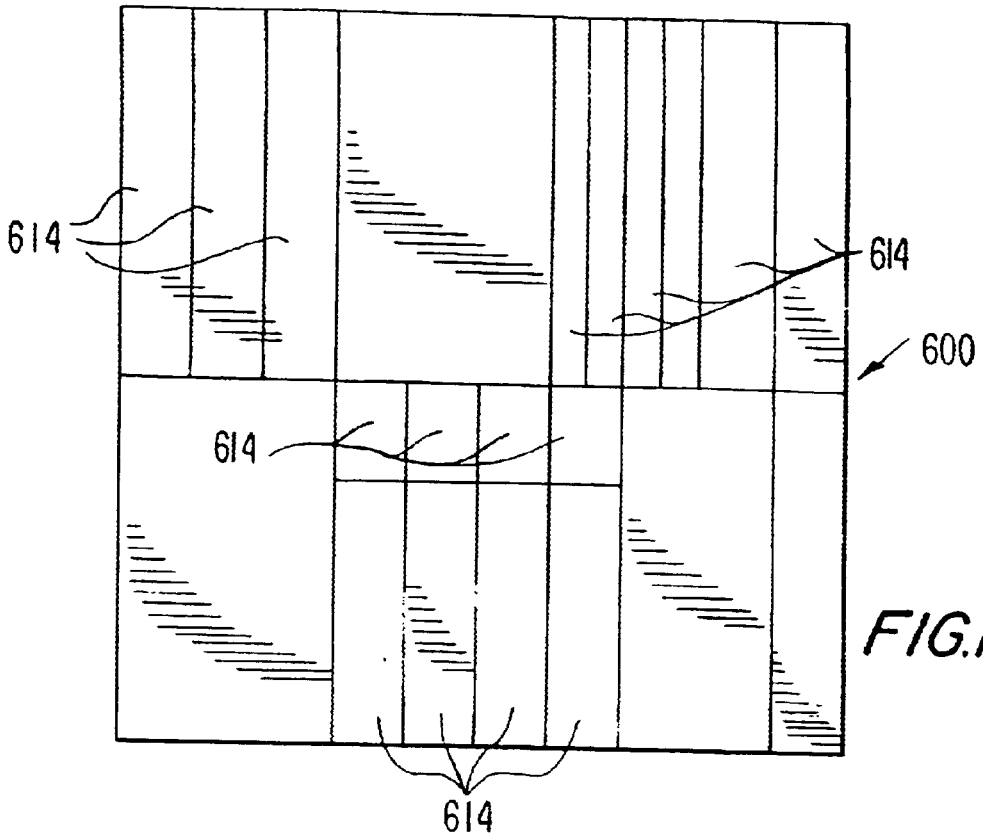
FIG. 18 is a diagrammatic representation of another display device configuration in accordance with the present invention.
Figure 19:
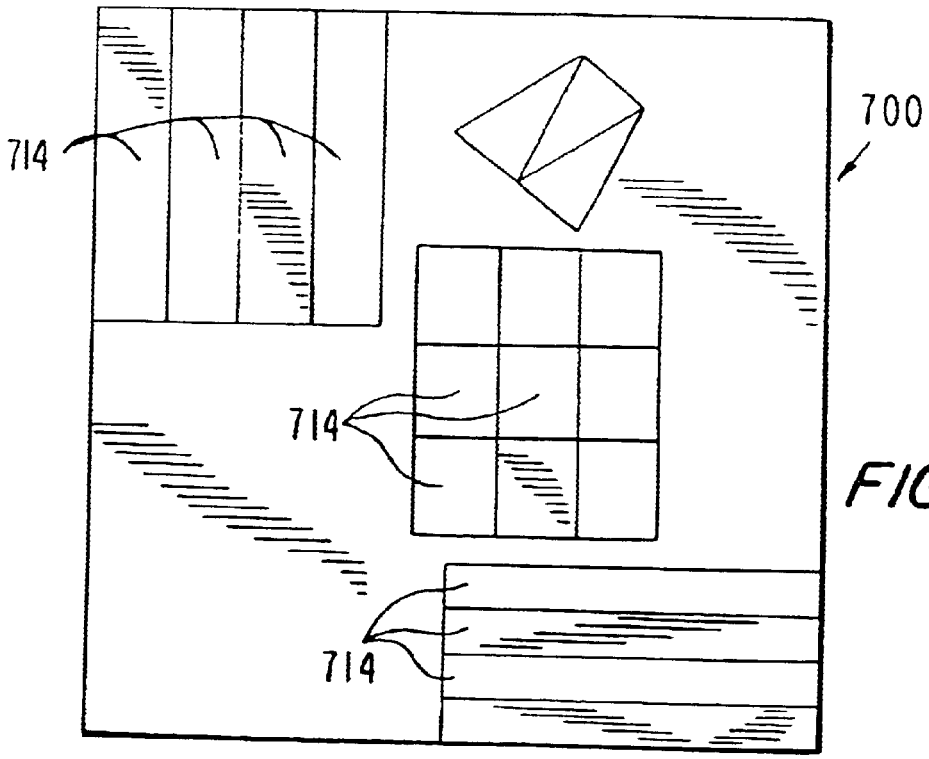
FIG. 19 is a diagrammatic representation of yet another display device configuration in accordance with the present invention.
Figure 24:
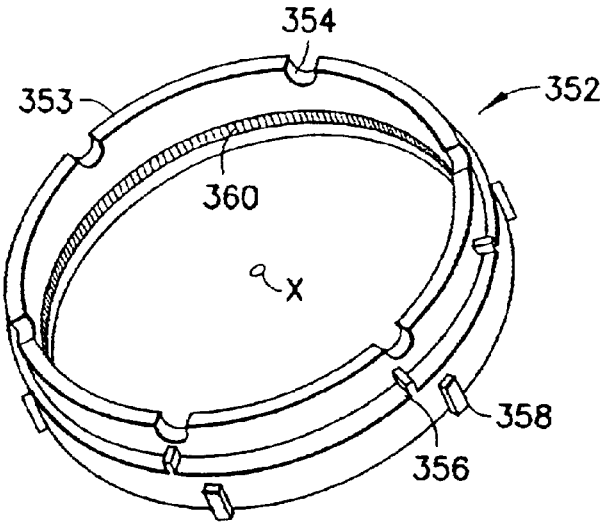
FIG. 24 is a ring gear for rotating display elements in the embodiment of FIG. 14.

As an alternative to the use of the crown gear 333 of FIG. 15 to rotate the display elements 314, a ring gear 352 as shown in FIG. 24 may be employed. In this embodiment, each display element will be fitted with an additional triangularly shaped gear or actuator 345 (FIG. 15) so that each display element will be controlled by gears 326*a* and 345. Each gear 345 is mounted to its display element at an axial displacement from gear 326*a* and radially misaligned therefrom so that the apexes of the triangular gears are offset from each other as shown in FIG. 15. The ring gear 352 is part of a ring assembly which is driven by a motor (not shown) preferably centrally located beneath the clock movement 315. The ring gear 352 allows the display device 300 to simultaneously rotate a subset of the display elements 314. A first set of actuating regions such as channels or indentations 354 are spaced along an edge 353 of the ring gear 352, and a second set of actuating regions, such as ribs or fingers 356 disposed along a circumference of the ring gear and circumferentially offset from channels 354. The edge 353 supports the actuators 345 mounted on or proximate the innermost end of each display element 314, and the fingers 356 will engage actuators 326*a*. Thus, as the ring gear 352 rotates about its axis "x", such as by engagement of inner teeth 360 by an engagement gear (not shown), triangular gears 326*a* will be contacted by fingers 356 to commence rotation of the display element, whereupon due to the circumferential misalignment of the fingers 356 with channels 354, the channels will engage actuator 345 to complete rotation of the display element so that a new panel is displayed on the viewing side of the housing. To simultaneously rotate 6 of the 12 centrally located display elements 314, the ring gear 352 is formed with 6 channels 354 and 6 fingers 356, each radially spaced from each other along the ring gear circumference by, for example, 60° separations, respectively. In other words, the ring gear 352 has one channel 354 and one actuator finger 356 for each display element 314 that is to be simultaneously rotated. Still other engagement techniques and designs will be readily apparent to those having ordinary skill for rotating the display elements.

In a preferred embodiment, the ring gear 352 also includes a plurality of fins 358 or extrusions to determine a current position of the display elements 314. These "position fins" 358 contact a stationary position switch as the ring gear 352 rotates. The position of the display elements 314 may be determined from the number of times the position switch contacts these fins 358.

In a still further embodiment, the ring gear may include only a single engagement channel and finger which, when the ring gear is rotated, will engage each display element one at a time in sequential order to cause an image to appear.

The ring gear 352 may be actuated in any known manner such as by use of pulleys and belts driven by a motor to impart rotational movement to the grooves 354 and, likewise, to the display elements in a manner described above. For example, the radially inward teeth 360 formed on an inner wall of the ring gear may be engaged by a motor driven gear (not shown). Other driving arrangements may also be readily envisioned by those having ordinary skill in the art.

Figure 25:
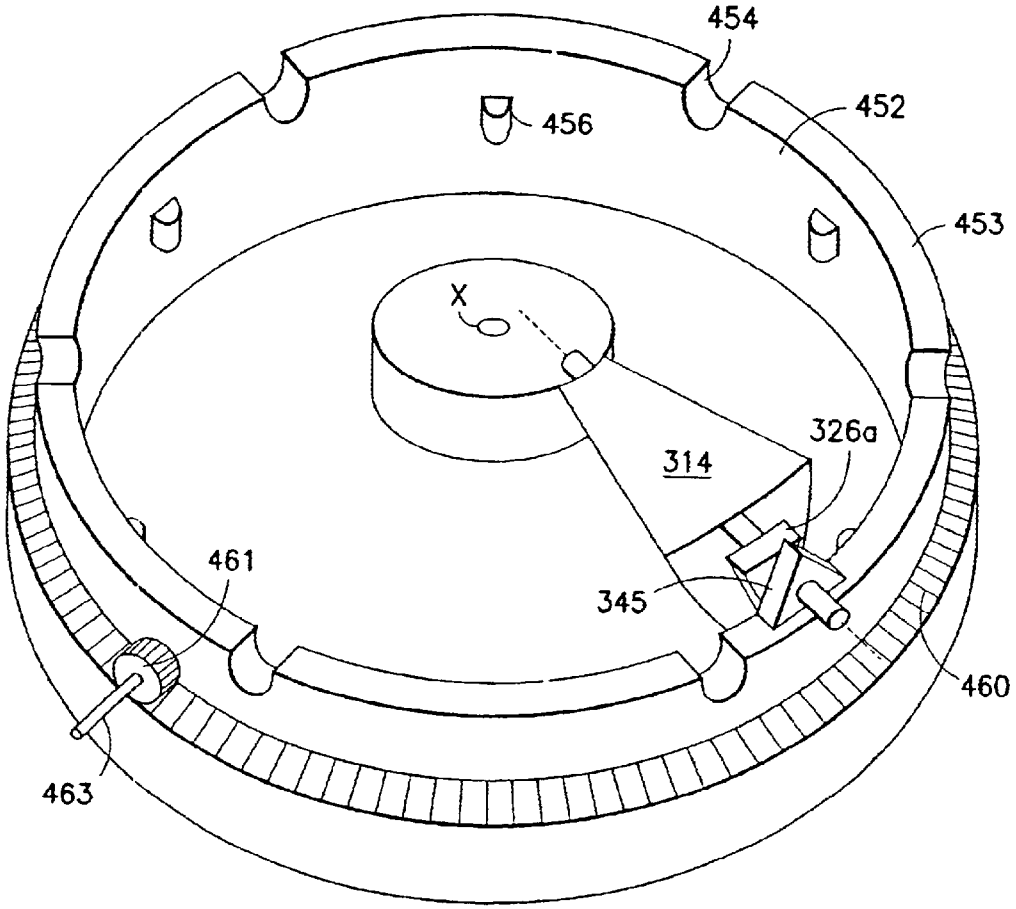
FIG. 25 shows an alternative embodiment of the ring gear of FIG. 24.

For example, and with reference to FIG. 25, a large diameter ring gear 452 may be employed for actuating the outer edges of the display elements 314, as opposed to the inner edges of the display elements in the embodiment discussed above and illustrated in FIGS. 23 and 24. In this embodiment, the triangular actuating gears 326*a* and 345 will be located at the far or wide end of each display element 314, with the plurality of display elements being bounded by the ring gear wall, as shown. Teeth 460 will be located on an outer surface of the ring gear wall (as opposed to the location on the inner surface as shown in FIG. 24), and may be engaged in any known manner such as via a drive gear 461 driven by an axle 463 connected to a motor, etc., to rotate the ring gear and, hence, the display elements. In this embodiment shown in FIG. 25, the inner ends of the display elements 314 can be more closely disposed next to each other to form a tighter circular display.

Figure 26:
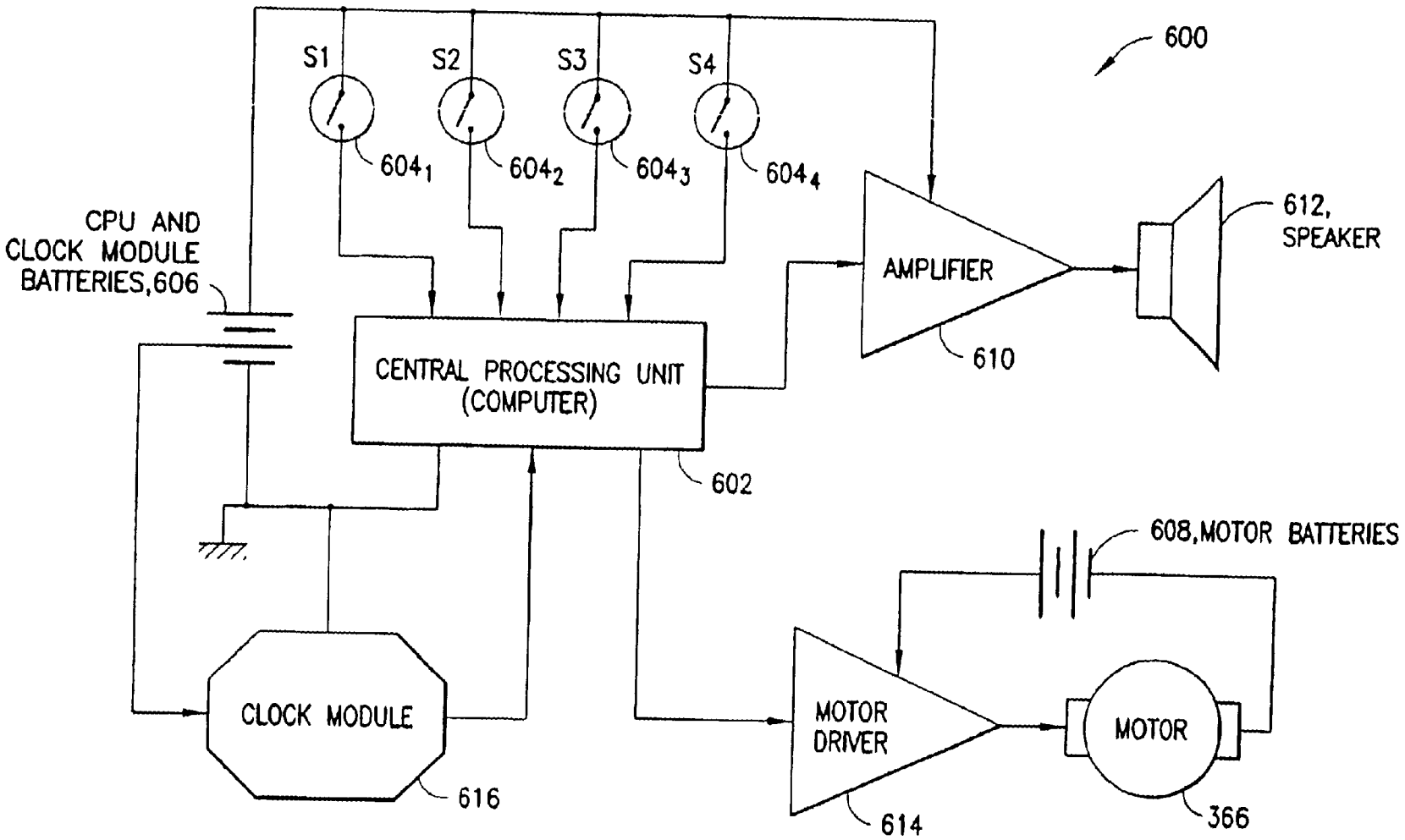
FIG. 26 is a block diagram of electrical components of the display of the embodiment of FIG. 14.
Figure 27:
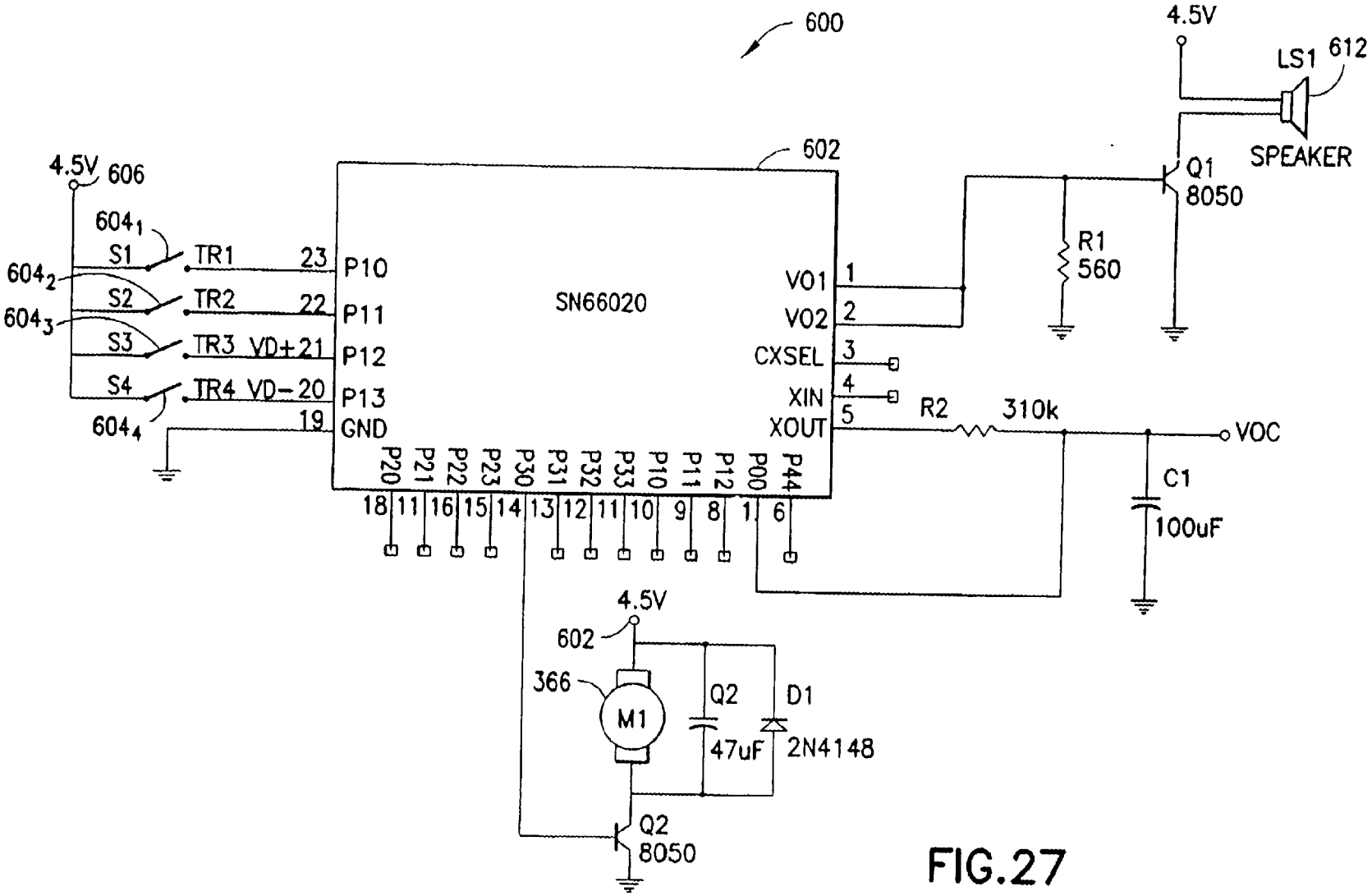
FIG. 27 is a schematic diagram of the block diagram of FIG. 26.

FIGS. 26 and 27 depict respective block and schematic diagrams of a programmed electronic circuit 600 for activating a motor 366 which drives the ring gear 352. The electronic circuit 600 comprises a central processing unit (CPU) 602, a plurality of switches $\mathbf{604}_1$, $\mathbf{604}_2$, $\mathbf{604}_3$, $\mathbf{604}_4$ (herein referred to generally as 604), one or more power sources 606 and 608, an amplifier 610, a speaker 612, a motor driver 614, and a clock module 616. The switches 604 include a position switch, a power switch, and an activation switch. The position switch comes into contact with the ring gear 352 which spins to rotate a subset of display elements 314 about their respective axes. As movement of the ring gear 352 is predetermined, the position of the display elements 314 is indicated by the number of times the position switch comes into contact with the ring gear 352. The power switch is a two-position switch that is moved to either couple or decouple the power source 606 to the CPU 602, the motor driver 614 and the amplifier 610, and thereby enable or disable the electronic circuit 600. If the electronic circuit 600 is enabled, the activation switch may be moved and thereby cause the CPU 602 to either activate or de-activate the amplifier 610 and the motor driver 614.

The power source(s) 606 and 608 provide power to the CPU 602, amplifier 610 and motor driver 614 in the electronic circuit when the power and activation switches are their appropriate positions. The CPU 602 provides an audio signal to the amplifier 610 and an motor activation signal to the motor driver 614 at specific predetermined times. The amplifier 610 amplifies an audio signal from the CPU 602 to the speaker 612. The motor driver 614 drives the motor 366 which then drives the ring gear 352 and the display elements 314.

In operation, a user initially activates the power switch so as to enable the electric circuit 600 in the display device 300 which also activates the CPU 602, amplifier 610 and motor driver 614. Once the user activates the activation switch, for example by pushing a button, the CPU 602 sends a signal to the motor driver 614 and the amplifier 610. The motor driver 614 drives the motor 366 which then drives the ring gear 352. The amplifier 610 amplifies an audio signal and provides the amplified audio signal to the speaker 612 where the signal is played.

Once driven by the motor 366, the ring gear 352 rotates the centrally located display elements 314. In a preferred embodiment, the motor 366 drives a plurality of gears which are coupled to the ring gear 352, thereby causing rotation of the display elements in the manner discussed above. The rotation of the display elements 314 causes a change in the visual images 318 on the panels 316. As the panels 316 of different display elements 314 continue to change, the overall image 318 defined by at least some of the plurality of display elements 314 also changes so as to convey a story. Different voices or sounds from the speaker 612 and/or different forms of lighting may accompany and synchronize the changes in story as depicted in the panels 316.

Figure 20:
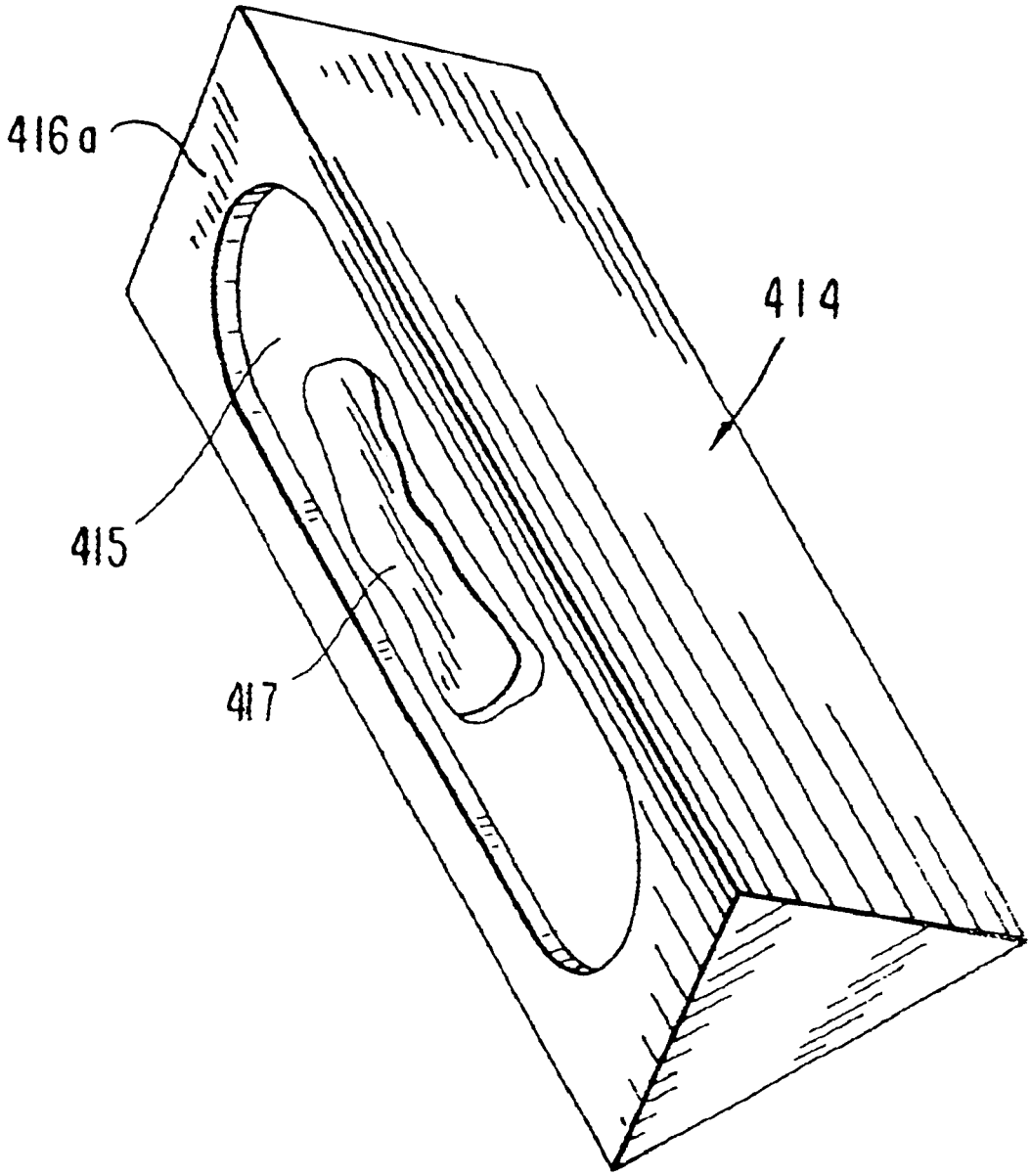
FIG. 20 is a perspective view of an alternative display element in accordance with the present invention.

Referring to FIG. 20, an alternative embodiment of a display element 414 may be formed with an opening 415 in a panel 416*a*. An object 417 may be mounted inside the display element behind the opening 415 such that the object is visible each time the panel 416*a* comes into view. Alternatively, openings 415 may be formed in more than one panel and different objects may be mounted behind each opening 415. Optionally the openings 415 may be covered with a transparent material, which may be flexible. Instead of mounting objects inside the display element 314 behind an opening 415, an object may be mounted directly on the surface of one or more panels 316, provided the objects do not impede rotation of the display elements 314.

Figure 21:
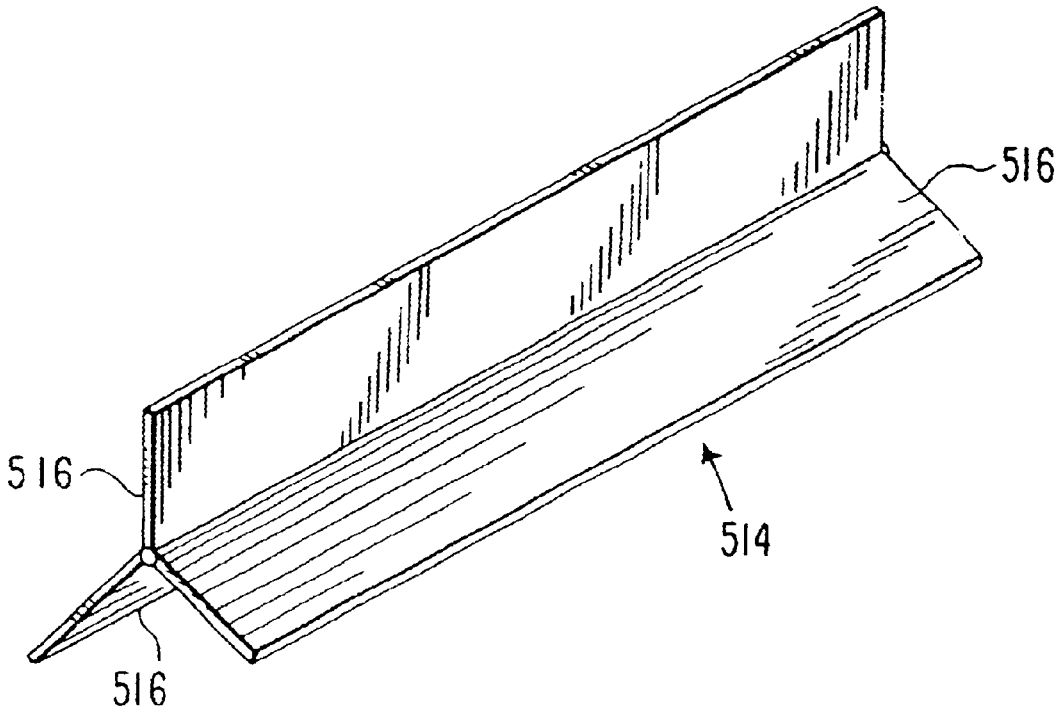
FIG. 21 is a perspective view of yet a further alternative display element in accordance with the present invention.

Referring to FIG. 21, as a still further alternative a display element 514 may be formed as an "inverted triangle" defining V-shape or, alternatively, concave panels 516. This embodiment is particularly suited for securing objects to the panels because the panels are recessed relative to the outer diameter of the display element 514. Alternatively, the panels are secured at the tip or end of the inverted triangle structure as shown in FIG. 22.

While there have been shown and described and pointed out fundamental novel features of the present invention as applied to preferred embodiments thereof, it will be understood that various omissions and substitutions and changes in the form and details of the devices illustrated, and in their operation, may be made by those of ordinary skill in the art without departing from the present invention. For example, while particular mechanisms for driving rotation of the display elements are shown and described, any suitable drive mechanism may be employed. It is expressly intended that all combinations of those elements and/or steps which perform substantially the same function in substantially the same way to achieve substantially the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims.

What is claimed is:

1. A display comprising:

a housing, said housing having a viewing side;

a plurality of display elements rotatably mounted in said housing in a circular array, each display element being rotatable about a respective fixed axis, each of said display elements having a plurality of sides, at least some of which carry visual images, said display elements being inwardly tapered from an outermost edge to an innermost edge; and a drive mechanism operatively connected to said display elements for rotating at least some of said display elements about said respective fixed axes for presenting visual effects at said viewing side.

2. The display of claim 1, wherein said drive mechanism is connected to the innermost edge of said display elements.

3. The display of claim 1, wherein said drive mechanism is connected to the outermost edge of said display elements.

4. The display of claim 1, further comprising a processor for controlling operation of said drive mechanism, and a drive mechanism memory operatively connected to said processor for storing instructions for operating said drive mechanism, said drive mechanism being operated in response to said operating instructions to rotate at least some of said plurality of display elements in a predetermined sequence and at predetermined times.

5. The display of claim 1, further comprising an actuator positioned at said innermost edge of each of said display elements, and wherein said drive mechanism comprises a ring gear having actuating regions for engaging at least some of said actuators for rotating said so-engaged actuators and said respective display elements.

6. The display of claim 5, wherein said actuator comprises a pair of triangularly-shaped gears angularly offset from each other, and wherein said ring gear actuating regions comprise a pair of actuating regions for engaging each triangularly-shaped gear.

7. The display of claim 1, further comprising a clock movement secured to said housing, said clock movement having clock hands disposed in front of the display elements for indicating the time of day.

8. The display of claim 7, wherein said plurality of display elements comprises twelve display elements.

9. The display of claim 7, wherein at least one side of each display element carries a clock hour image thereon.

10. The display of claim 1, wherein said visual images represent a clock face.

11. The display of claim 1, further comprising:

a speaker mounted on said housing;

a sound signal generator operatively connected to said speaker for causing said speaker to emit sound;

a sound signal memory device storing a sound scheme signal and operatively connected to said sound signal generator; and said processor being operatively connected to said sound signal memory device and to said drive mechanism memory for synchronizing sound emitted by said speaker with the visual image effects presented upon rotation of said display elements.

12. The display of claim 11, wherein said sound scheme signal stored in said sound signal memory device comprises at least one of music and a spoken message, wherein said sequence of visual effects relate to matters in the said at least one of music and a spoken message, and wherein said display elements are rotated so that selected visual images on the sides of said display elements are displayed at said housing viewing side in synchronization with said at least one of music and a spoken message.

13. A display comprising:

a housing, said housing having a viewing side;

a plurality of display elements rotatably mounted in said housing in a circular array, each display element being rotatable about a respective fixed axis, each of said display elements having a plurality of sides, at least some of which carry visual images; and a drive mechanism comprising a ring gear operatively connected to said plurality of display elements for rotating at least one display element about said respective fixed axis upon activation of said drive mechanism for presenting a visual image on said housing viewing side.

14. The display of claim 13, wherein each display element comprises an actuating gear disposed at an end of said display element for engagement with said ring gear.

15. The display of claim 14, wherein said actuating gear comprises a pair of triangularly-shaped gears angularly offset from each other and positioned at an innermost end of each display element, and wherein said ring gear comprises a pair of engagement regions for engaging each triangularly-shaped actuating gear upon rotation of said ring gear.

16. The display of claim 14, wherein said actuating gear comprises a pair of triangularly-shaped gears angularly offset from each other and positioned at an outermost end of each display element, and wherein said ring gear comprises a pair of engagement regions for engaging each triangularly-shaped actuating gear upon rotation of said ring gear.

17. The display of claim 13, wherein said visual images comprise recognizable indicia representing a clock face.

18. The display of claim 13, further comprising a clock movement secured to said housing, said clock movement having clock hands disposed in front of the display elements for indicating the time of day.

19. The display of claim 13, wherein each said display element is inwardly tapered from an outermost wide edge to an innermost narrow edge.

20. The display of claim 13, wherein said at least one display element has an opening on a surface for displaying an object.

* * * * *